US010553146B2

(12) United States Patent
Pyo et al.

(10) Patent No.: US 10,553,146 B2
(45) Date of Patent: Feb. 4, 2020

(54) DISPLAY DEVICE AND METHOD OF DRIVING THE SAME

(71) Applicant: Samsung Display Co., Ltd., Yongin-si, Gyeonggi-Do (KR)

(72) Inventors: Si-Beak Pyo, Cheonan-si (KR); Min-Tak Lee, Hwaseong-si (KR); Young-Nam Yun, Suwon-si (KR); Kyu-Seok Kim, Asan-si (KR); Hyun-Koo Lee, Seoul (KR); Young-Sik Lim, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 214 days.

(21) Appl. No.: 15/409,191

(22) Filed: Jan. 18, 2017

(65) Prior Publication Data

US 2017/0294156 A1 Oct. 12, 2017

(30) Foreign Application Priority Data

Apr. 12, 2016 (KR) ..... 10-2016-0045035

(51) Int. Cl.

| | |
|---|---|
| ***G09G 3/3233*** | (2016.01) |
| ***G09G 3/20*** | (2006.01) |
| *G09G 3/3266* | (2016.01) |
| *G09G 3/3275* | (2016.01) |
| *G09G 3/36* | (2006.01) |

(52) U.S. Cl.

CPC ..... *G09G 3/2077* (2013.01); *G09G 3/2003* (2013.01); *G09G 3/3233* (2013.01); *G09G 3/3266* (2013.01); *G09G 3/3275* (2013.01); *G09G 3/3677* (2013.01); *G09G 3/3688* (2013.01); *G09G 2300/0452* (2013.01); *G09G 2300/0819* (2013.01); *G09G 2310/08* (2013.01); *G09G 2320/0626* (2013.01); *G09G 2320/0666* (2013.01); *G09G 2330/023* (2013.01);

(Continued)

(58) Field of Classification Search

CPC ..... G09G 2330/00–12; G09G 3/013; G09G 3/2003; G09G 3/2077; G09G 3/3233–3258; G09G 2300/0452; G09G 2300/0819; G09G 2310/08; G09G 2320/0271; G09G 2320/06–0693; G09G 2330/023; G09G 2354/00; G09G 2360/16

USPC ..... 345/76–83

See application file for complete search history.

(56) References Cited

U.S. PATENT DOCUMENTS 8,451,554 B2 5/2013 Kim et al.
9,766,701 B2 * 9/2017 Plowman ..... G06F 3/013

(Continued)

FOREIGN PATENT DOCUMENTS

CN 103198779 A 7/2013
KR 10-0702103 B1 4/2007

(Continued)

OTHER PUBLICATIONS

European Search Report, Appl. No. 17163390.2, dated Oct. 10, 2017, pp. 1-16.

*Primary Examiner* — Amr A Awad
*Assistant Examiner* — Aaron Midkiff
(74) *Attorney, Agent, or Firm* — Innovation Counsel LLP

(57) ABSTRACT

A display device includes a display panel including pixels; and a timing controller to calculate a grayscale usage ratio of input data and to determine an automatic-current-limit rate based on the grayscale usage ratio, the automatic-current-limit rate representing a power saving rate.

15 Claims, 14 Drawing Sheets

(52) U.S. Cl.
CPC ... *G09G 2354/00* (2013.01); *G09G 2360/144* (2013.01); *G09G 2360/16* (2013.01)

(56) References Cited

U.S. PATENT DOCUMENTS

| | | | | |
|---|---|---|---|---|
| 2010/0214325 | A1* | 8/2010 | Koyama | G09G 3/3406 345/690 |
| 2011/0216097 | A1 | 9/2011 | Yoo et al. | |
| 2012/0069055 | A1* | 3/2012 | Otsuki | G06F 3/017 345/681 |
| 2012/0075361 | A1* | 3/2012 | Kishi | G09G 3/3225 345/690 |
| 2012/0133790 | A1* | 5/2012 | Sams | G06T 15/60 348/222.1 |
| 2012/0182515 | A1 | 7/2012 | Pyo | |
| 2012/0249514 | A1* | 10/2012 | Ahn | G09G 3/3233 345/212 |
| 2013/0021349 | A1* | 1/2013 | Kohtoku | G02F 1/13318 345/501 |
| 2013/0127923 | A1 | 5/2013 | An et al. | |
| 2013/0169693 | A1 | 7/2013 | Pyo | |
| 2013/0176349 | A1 | 7/2013 | Park et al. | |
| 2013/0194316 | A1 | 8/2013 | Park et al. | |
| 2014/0078198 | A1* | 3/2014 | Roh | G09G 3/2003 345/694 |
| 2014/0125714 | A1 | 5/2014 | Pyo | |
| 2015/0097764 | A1 | 4/2015 | Pyo et al. | |
| 2015/0138251 | A1 | 5/2015 | Pyo | |
| 2015/0187264 | A1 | 7/2015 | Pyo | |
| 2015/0228224 | A1 | 8/2015 | Park et al. | |
| 2015/0279274 | A1 | 10/2015 | Pyo | |
| 2015/0348505 | A1 | 12/2015 | Pyo | |
| 2015/0364076 | A1 | 12/2015 | Park et al. | |
| 2015/0364089 | A1 | 12/2015 | Pyo et al. | |
| 2016/0081240 | A1 | 3/2016 | Lee et al. | |
| 2016/0189619 | A1* | 6/2016 | Park | G09G 3/3258 345/690 |
| 2016/0189676 | A1 | 6/2016 | Pyo | |
| 2016/0365024 | A1 | 12/2016 | Pyo | |

FOREIGN PATENT DOCUMENTS

| | | | |
|---|---|---|---|
| KR | 10-2010-0090975 | A | 8/2010 |
| KR | 10-2012-0084078 | A | 7/2012 |
| KR | 10-2013-0055256 | A | 5/2013 |
| KR | 10-2013-0081451 | A | 7/2013 |
| KR | 10-2013-0086877 | A | 8/2013 |
| KR | 10-2014-0058283 | A | 5/2014 |
| KR | 20140075352 | A | 6/2014 |
| KR | 10-2015-0010807 | A | 1/2015 |
| KR | 10-2015-0040095 | A | 4/2015 |
| KR | 10-2015-0056940 | A | 5/2015 |
| KR | 10-2015-0114020 | A | 10/2015 |
| KR | 10-2015-0139014 | A | 12/2015 |
| KR | 10-2015-0139481 | A | 12/2015 |
| KR | 10-2015-0142830 | A | 12/2015 |
| KR | 10-2015-0142943 | A | 12/2015 |
| KR | 10-2016-0081240 | | 7/2016 |
| KR | 10-2016-0148128 | A | 12/2016 |
| TW | 201329954 | A1 | 7/2013 |

* cited by examiner

FIG. 7

| | CONVENTIONAL | | | | | PRESENT INVENTION | | | | |
|---|---|---|---|---|---|---|---|---|---|---|
| | OPR | ACL | V255 | AID | PANEL POWER | OPR | ACL | V255 | AID | PANEL POWER |
| | 100% | 8% | 246 | Def. | 1,371mW | 100% | 25% | 234 | 0.92%*ON | 1,166mW (▼15%) |
| | 33% | 0% | 255 | Def. | 700mW | 100% | 25% | 234 | 0.92%*ON | 552mW (▼21%) |
| | 87% | 5.5% | 249 | Def. | 1,137mW | 90% | 20% | 243 | 0.94%*ON | 1,033mW (▼9%) |
| | 78% | 3.7% | 251 | Def. | 921mW | 78% | 3.7% | 255 | 0.96%*ON | 926mW (▲0.5%) |

DISPLAY DEVICE AND METHOD OF DRIVING THE SAME

CROSS-REFERENCE TO RELATED APPLICATION(S)

This application claims priority under 35 USC § 119 to Korean Patent Application No. 10-2016-0045035, filed on Apr. 12, 2016 in the Korean Intellectual Property Office (KIPO), the contents of which are incorporated herein in its entirety by reference.

BACKGROUND

1. Technical Field

Example embodiments relate to a display device. More particularly, embodiments of the present inventive concept relate to a display device and a method of driving a display device to reduce power consumption.

2. Description of the Related Art

A display device may display an image based on input data. The display device may reduce power consumption of the display device by calculating an on-pixel ratio (OPR) of the input data and by converting (or, reducing, downscaling, downsizing) the input data based on the on-pixel ratio. For example, first power consumption corresponding to first input data which has a relatively higher on-pixel ratio is greater than second power consumption corresponding to second input data which has a relatively lower on-pixel ratio. Therefore, the display device may reduce the first power consumption by reducing the first input data.

An effect of reducing the power consumption is improved by converting (or, reducing) the input data. However, an available range of grayscales in the display device may be reduced, some grayscales may be united, or some grayscales may be skipped. That is, an image corresponding to the input data may be distorted.

SUMMARY

Some example embodiments provide a display device to maximize an effect of reducing power consumption.

Some example embodiments provide a display device to minimize a distortion of an image.

Some example embodiments provide a method of driving a display device efficiently.

According to example embodiments, a display device may include a display panel including pixels; and a timing controller to calculate a grayscale usage ratio of input data and to determine an automatic-current-limit rate based on the grayscale usage ratio, where the automatic-current-limit rate represents a power saving rate.

In example embodiments, the grayscale usage ratio may be a ratio of a number of valid grayscale levels included in the input data to a total number of grayscale levels used in the display device, where a usage ratio of each of the valid grayscale levels is greater than a predetermined reference value.

In example embodiments, the timing controller may calculate the automatic-current-limit rate based on a first reference rate when the grayscale usage ratio is greater than a reference grayscale usage ratio and may calculate the automatic-current-limit rate based on the first reference rate and a second reference rate when the grayscale usage ratio is less than a reference grayscale usage ratio, where the second reference rate is greater than the first reference rate.

In example embodiments, the timing controller may determine a grayscale region corresponding to a previous grayscale usage ratio of previous input data among grayscale regions, to increase the automatic-current-limit rate when the grayscale usage ratio is less than a minimum value of the grayscale region, and to decrease the automatic-current-limit rate when the grayscale usage ratio is greater than a maximum value of the grayscale region by a predetermined threshold value, where each of the grayscale regions is included in a range which is less than the reference grayscale usage ratio, and each of the grayscale regions has a width which is equal to the predetermined threshold value.

In example embodiments, the timing controller may calculate an input luminance of the input data and to calculate an output luminance of the input data by reducing the input luminance based on the automatic-current-limit rate, and the display panel may display an image corresponding to the input data based on the output luminance.

In example embodiments, the timing controller may calculate an average on-pixel ratio of the pixels and a maximum on-pixel ratio of the pixels based on the input data and may calculate the input luminance based on the average on-pixel ratio and the maximum on-pixel ratio.

In example embodiments, the average on-pixel ratio may be a ratio of a number of valid pixels which is activated based on the input data to a total number of the pixels, wherein the maximum on-pixel ratio is a largest on-pixel ratio among sub average on-pixel ratios which are respectively calculated for each of the pixels having a same color.

In example embodiments, the timing controller may calculate the input luminance based on the average on-pixel ratio when the grayscale usage ratio is greater than the reference grayscale usage ratio and may calculate the input luminance based on the average on-pixel ratio and the maximum on-pixel ratio when the grayscale usage ratio is less than the reference grayscale usage ratio.

In example embodiments, the timing controller may calculate a first reduction rate to reduce on-duty of the pixels and a second reduction rate to downsize the input data based on the automatic-current-limit rate, where the second reduction rate is equal to a excess-rate by which the automatic-current-limit rate excesses a reference reduction rate, and the automatic-current-limit rate is equal to a sum of the first reduction rate and the second reduction rate.

In example embodiments, the display device may further include an emission driver to generate a light emission control signal to control the on-duty based on the first reduction rate.

In example embodiments, the timing controller may generate converted data by downsizing the input data based on the second reduction rate.

In example embodiments, the timing controller may increase a chroma on a color difference coordinate of the converted data.

In example embodiments, the display device may further include driving modes including a normal driving mode and a power saving driving mode; and a graphic user interface configured to control the driving mode, and the timing controller may calculate the automatic-current-limit rate in the power saving driving mode and may not calculate the automatic-current-limit rate in the normal driving mode.

In example embodiments, the display device may further include a visual recognition sensor configured to detect a view angle of a user, may determine an unapplied area of the display panel corresponding to the viewing angle, and may calculate the automatic-current-limit rate based on the unapplied area.

In example embodiments, the display device may further include a hovering sensor to detect an object between the user and the display panel, and the timing controller may determine the unapplied area based on the view angle and a location of the object.

In example embodiments, the display device may further include a gravity sensor and light sensor, may calculate a location of a light source, may determine an applied area based on the location of the light source, and may calculate the automatic-current-limit rate based on partial data corresponding to the applied area.

According to example embodiments, a display device may include a display panel including pixels; and a timing controller to calculate an average on-pixel ratio of the pixels and a maximum on-pixel ratio of the pixels based on input data, to calculate an input luminance of the input data based on the average on-pixel ratio and the maximum on-pixel ratio, and to calculate an output luminance by reducing the input luminance when the input luminance is greater than a reference luminance, where the display panel displays an image corresponding to the input data with the output luminance.

In example embodiments, the average on-pixel ratio may be a ratio of a number of valid pixels which is activated based on the input data to a total number of the pixels, where the maximum on-pixel ratio may be a largest on-pixel ratio among sub average on-pixel ratios which are respectively calculated for each of the pixels having a same color.

In example embodiments, the timing controller may calculate a grayscale usage ratio of the input data, may calculate the input luminance based on the average on-pixel ratio when the grayscale usage ratio is greater than a reference grayscale usage ratio, and may calculate the input luminance based on the average on-pixel ratio and the maximum on-pixel ratio when the grayscale usage ratio is less than the reference grayscale usage ratio. Here, the grayscale usage ratio may be a ratio of a number of valid grayscale levels included in the input data to a total number of grayscale levels used in the display device, where a usage ratio of each of the valid grayscale levels is greater than a predetermined reference value.

According to example embodiments, a method of driving a display device may include calculating a grayscale usage ratio of input data and an input luminance of the input data; determining an automatic-current-limit rate based on the grayscale usage ratio, the automatic-current-limit rate representing a power saving rate; calculating output luminance of the input data by reducing the input luminance based on the automatic-current-limit rate when the input luminance is greater than a reference luminance; and displaying an image corresponding to the input data with the output luminance.

Therefore, a display device according to example embodiments may maximize an effect of reducing the power consumption by calculating an input luminance based on an average on-pixel ratio and a maximum on-pixel ratio of input data.

In addition, the display device may minimize a distortion of an image by calculating an automatic-current-limit rate based on a grayscale usage ratio of input data, by preferentially using the impulsive dimming driving method to control an on-duty of a pixel based on the automatic-current-limit rate, and by using the image converting method for the excess-rate of the automatic-current-limit rate.

Furthermore, a method of driving a display device according to example embodiments may drive a display device efficiently.

BRIEF DESCRIPTION OF THE DRAWINGS

Illustrative, non-limiting example embodiments will be more clearly understood from the following detailed description taken in conjunction with the accompanying drawings.

FIG. 7 is a diagram illustrating an example of power consumption of the display device of FIG. 1.

DESCRIPTION OF EMBODIMENTS

Hereinafter, the present inventive concept will be explained in detail with reference to the accompanying drawings.

Figure 1:
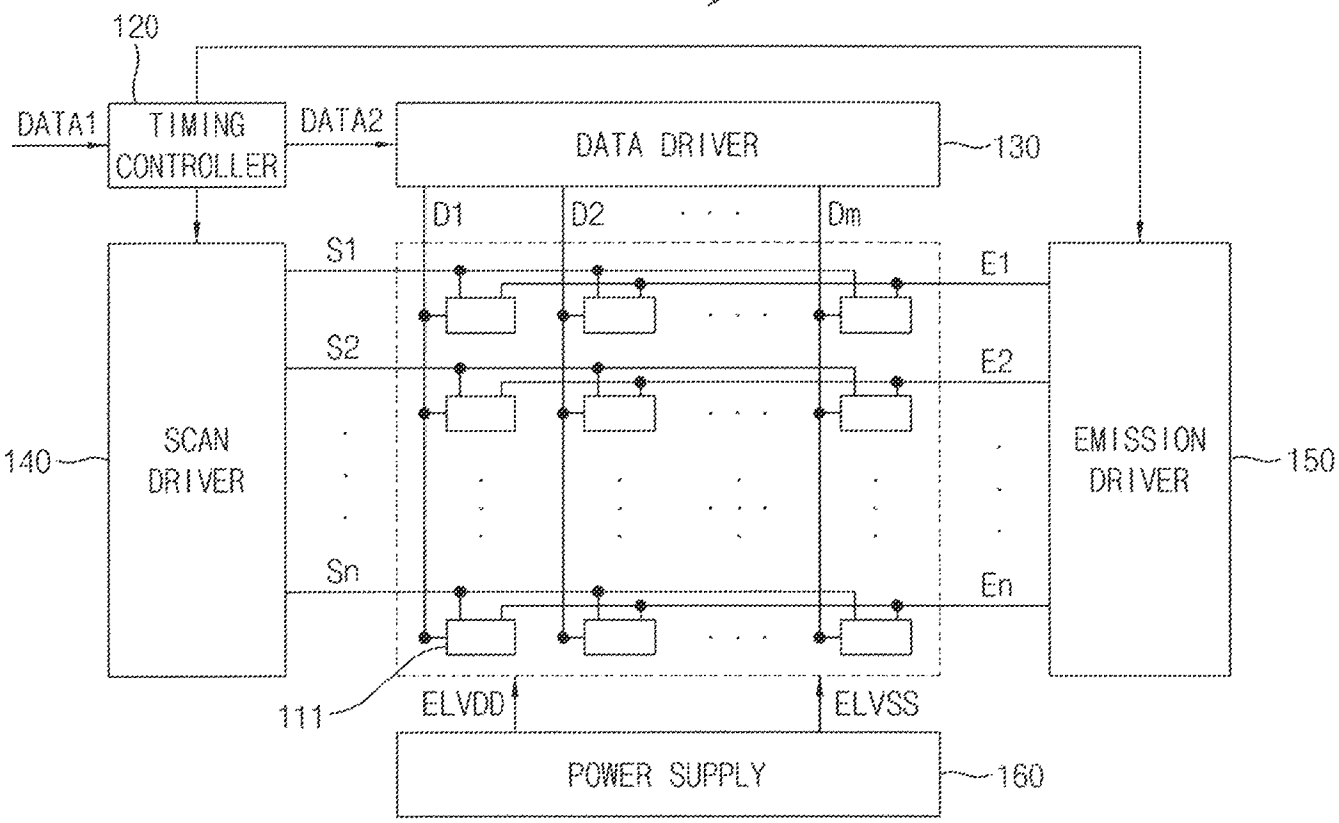
FIG. 1 is a block diagram illustrating a display device according to example embodiments.

FIG. 1 is a block diagram illustrating a display device according to example embodiments.

Referring to FIG. 1, the display device 100 may include a display panel 110, a timing controller 120, a data driver 130, a scan driver 140, an emission driver 150 (or, a light emission driver), and a power supply 160 (or, a power supplier). The display device 100 may display an image based on image data DATA1 provided from an external component. For example, the display device 100 may be an organic light emitting display device.

The display panel 110 may include gate lines S1 through Sn, data lines D1 through Dm, light emission control lines E1 through En, and pixels 111 (or, pixel circuits), where each of n and m is an integer greater than or equal to 2. The pixels 111 may be disposed in cross-regions of the gate lines S1 through Sn, the data lines D1 through Dm, and the light emission control lines E1 through En, respectively.

Each of the pixels 111 may store a data signal (i.e., a data signal provided through the data lines D1 through Dm) in response to a gate signal (i.e., a gate signal provided through the gate lines S1 through Sn), and may emit light based on a stored data signal in response to a light emission control signal (i.e., a light emission control signal provided through the light emission control lines E1 through En).

In some example embodiments, the pixels 111 may include a first pixel (or a first type pixel, a first sub pixel) emitting light with a first color (e.g., a red color), a first pixel (or a first type pixel, a first sub pixel) emitting a second color (e.g., a green color), and a first pixel (or a first type pixel, a first sub pixel) emitting a third color (e.g., a blue color). For example, the pixels 111 may further include a fourth pixel (or a fourth type pixel, a fourth sub pixel) emitting light with a fourth color (e.g., a white color). A configuration of the pixels 111 will be described in detail with reference to FIG. 5.

The timing controller 120 may calculate a grayscale usage ratio of the input data and may determine an automatic-current-limit rate based on the grayscale usage ratio. In addition, the timing controller 120 may calculate an input luminance of the input data and may calculate an output luminance (e.g., a reduced luminance) of the input data by reducing the input luminance based on the automatic-current-limit rate when the input luminance is greater than a reference luminance. In this case, the display device 110 (or, the pixels 111) may display an image corresponding to the input data with the output luminance.

Here, the grayscale usage ratio may be a ratio of a number of valid grayscale levels, which are included in the input data, to a total number of grayscale levels used in the display device 100. The valid grayscale levels may have a usage ratio which is greater than a predetermined reference value (e.g., 0% or 0.03%). The automatic-current-limit rate may be a reduction rate of power consumption of the display device 100. For example, the automatic-current-limit rate may be in a range of 8% through 25%. In this case, power consumption of the display device 100 may be reduced by 8% through 25% with respect to power consumption of a conventional display device which do not employ an automatic-current-limit technique.

For reference, the automatic-current-limit technique may reduce (or, limit) power consumption of the display device 100 (or, a current provided to the display panel 110 or the pixels) by using an impulsive dimming driving method or an image converting method.

The impulsive dimming driving method may insert an on-duty of the pixels (or, a light emission period in which the pixels 111 emit lights) and an off-duty (or, a light non-emission period in which the pixels 111 emit no lights) into a display period (e.g., a time period in which an image is displayed by the pixels 111) and may driving the pixels 111 with dimming according to the on-duty and the off-duty. For example, the impulsive dimming driving method may reduce power consumption of the display device 100 by reducing the on-duty of the pixels 111 (or, by increasing the off-duty of the pixels 111).

The image converting method (or, a data remapping method) may increase or decrease the input data (or, may upscale or downscale amplitudes of grayscales included in the input data). For example, the image converting method may reduce the power consumption of the display device 100 by reducing the input data or by remapping the input data in a reduced grayscale range.

In some example embodiments, the timing controller 120 may calculate an average on-pixel ratio and a maximum on-pixel ratio of the pixels 111 based on the input data and may calculate the input luminance based on the average on-pixel ratio and the maximum on-pixel ratio. For reference, an on-pixel ratio (referred as "OPR") may be a ratio of a driving amount of the input data (e.g., an amount of driving current when the pixels 111 are driven based on the input data) to a maximum driving amount (e.g., an amount of driving current when all of the pixels 111 are driven based on a maximum grayscale). For example, the on-pixel ratio may be a ratio of a number of valid pixels, which are activated based on the input data (e.g., the first data DATA1)), to a total number of the pixels 111 included in the display panel 110. When the pixels 111 includes the first pixel (or the first type pixel), the second pixel (or the type pixel) and the third pixel (or the third type pixel), the average on-pixel ratio may be a ratio of an amount of driving current for the pixels 111 to the maximum amount of driving current for the pixel (or a ratio of a number of the valid pixels which are activated (or, turned on) based on the input data to the total number of the pixels 111), the first sub on-pixel ratio may be a ratio of an amount of driving current for the pixel to an maximum amount of driving current for the pixels 111, the second sub on-pixel ratio may be a ratio of an amount of driving current for the second pixel to the maximum amount of driving current for the pixels 111, the third sub on-pixel ratio may be a ratio of an amount of driving current for the third pixel to the maximum amount of driving current for the pixels 111, and the maximum on-pixel ratio may be a largest one among the first through third on-pixel ratios. That is, the maximum on-pixel ratio may be a largest one among sub average on-pixel ratios which are respectively calculated for each of the pixels having a same color.

When input data corresponding to an image using only one color among three colors (e.g., red/green/blue colors) is provided to the display device 100, the input luminance of the image, which is calculated using only an average on-pixel ratio, may be lower than 33% of a maximum luminance of the display device (100), and the display device 100 may determine that reduction of power consumption for the display device 100 is not be needed.

The display device 100 according to example embodiments may calculate the input luminance based on the average on-pixel ratio and the maximum on-pixel ratio. For example, the display device 100 according to the example embodiments may calculate the input luminance based on the maximum on-pixel ratio for an image including only one color (e.g., the input luminance is 60%). In this case, the display device 100 may reduce power consumption of the display device 100 by reducing the input luminance based on the automatic-current-limit rate. That is, an effect of reducing power consumption will be improved.

A method of determining the automatic-current-limit rate and a method of calculating the input luminance will be explained in detail with reference to FIG. 2.

The display device 100 may use the impulsive dimming driving method and the image converting method based on the automatic-current-limit rate. For example, the timing controller 120 may calculate a first reduction rate and a second reduction rate according to the automatic-current-limit rate, may reduce on-duty of the pixels 111 based on the first reduction rate (i.e., may use the impulsive dimming driving method), and may reduce the input data based on the second reduction rate (i.e., may use the impulsive dimming driving method and the image converting method). Here, the first reduction rate may be less than a reference reduction rate (e.g., 8%), the second reduction rate may be an excess-rate by which the automatic-current-limit rate excesses the reference reduction rate, and the automatic-current-limit rate may be equal to a sum of the first reduction rate and the second reduction rate.

The image converting method may reduce power consumption more efficiently than the impulsive dimming driving method, but an image may be distorted or degraded. The impulsive dimming driving method may reduce the power consumption without an image distortion within a certain rate (e.g., when the automatic-current-limit rate is within the certain rate), but a gamma deflection, color shifting, and etc. may occur when the automatic-current-limit rate excesses the certain rate.

Therefore, the display device 100 may reduce the power consumption without the image distortion by preferentially using the impulsive dimming driving method for the certain rate (e.g., within the reference reduction rate) and may maximize an effect of reducing the power consumption by using the image converting method for the excess-rate.

In some example embodiments, the timing controller 120 may control the data driver 130, the scan driver 140, and the emission driver 150. The timing controller 120 may generate a gate driving control signal and may provide the gate driving control signal to the scan driver 140. The timing controller 120 may generate a data driving control signal and may provide converted data (e.g., second data DATA2) and the data driving control signal to the data driver 130. The timing controller 120 may generate a light emission driving control signal and may provide the light emission driving control signal to the emission driver 150.

The data driver 130 may generate the data signal based on the converted data (e.g., second data DATA2). The data driver 130 may provide the display panel 110 with the data signal in response to the data driving control signal.

The scan driver 140 (or, a gate driver) may generate the gate signal based on the gate driving control signal. The gate driving control signal may include a start signal (or, a start pulse) and clock signals, and the scan driver 140 may include gate driving units (or, shift registers) sequentially generating the gate signal based on the start signal and the clock signals.

The emission driver 150 may generate a light emission driving control signal based on the light emission driving control signal and may provide the light emission control signal to the pixels 111 through the light emission control lines E1 through En. The emission driver 150 may determine the on-duty (or, a light emission period) of the pixels 111 and/or the off-duty (or, a light non-emission period) of the pixels 111 based on the light emission driving control signal. In this case, the pixels 111 may emit lights in response to the light emission control signal having a logic low level (or, a low voltage, a low voltage level, a turn-on voltage) and may emit no light in response to the light emission control signal having a logic high level (or, a high voltage, a high voltage level, a turn-off voltage)

The power supply 160 may generate a driving voltage for driving the display device 100. The driving voltage may include a first power voltage ELVDD and a second power voltage ELVSS. The first power voltage ELVDD may have a voltage level higher than a voltage level of the second power voltage ELVSS.

As described above, the display device 100 according to example embodiments may calculate the grayscale usage ratio of the input data, may determined the automatic-current-limit rate based on the grayscale usage ratio, may calculate the input luminance of the input data, may calculate the output luminance (or, a reduced luminance) of the input data by reducing the input luminance based on the automatic-current-limit rate when the input luminance is greater than the reference luminance, and may display an image corresponding to the input data with the output luminance. Here, the display device 100 may calculate the average on-pixel ratio and the maximum on-pixel ratio of the pixels 111 based on the input data and may calculate the input luminance based on the average on-pixel ratio and the maximum on-pixel ratio. Therefore, the display device 100 may minimize a distortion of a quality-first image and may maximize an effect of reducing power consumption of operation-first image (or, an image using one or two color(s)).

In addition, the display device 100 may use the impulsive dimming driving method for some automatic-current-limit rates less than a certain rate (e.g., the reference reduction rate, 8%) and may use the image converting method for some automatic-current-limit exceeding the certain rate (e.g., the reference reduction rate, 8%). Therefore, the display device 100 may generally minimize the distortion of the image.

Figure 2:
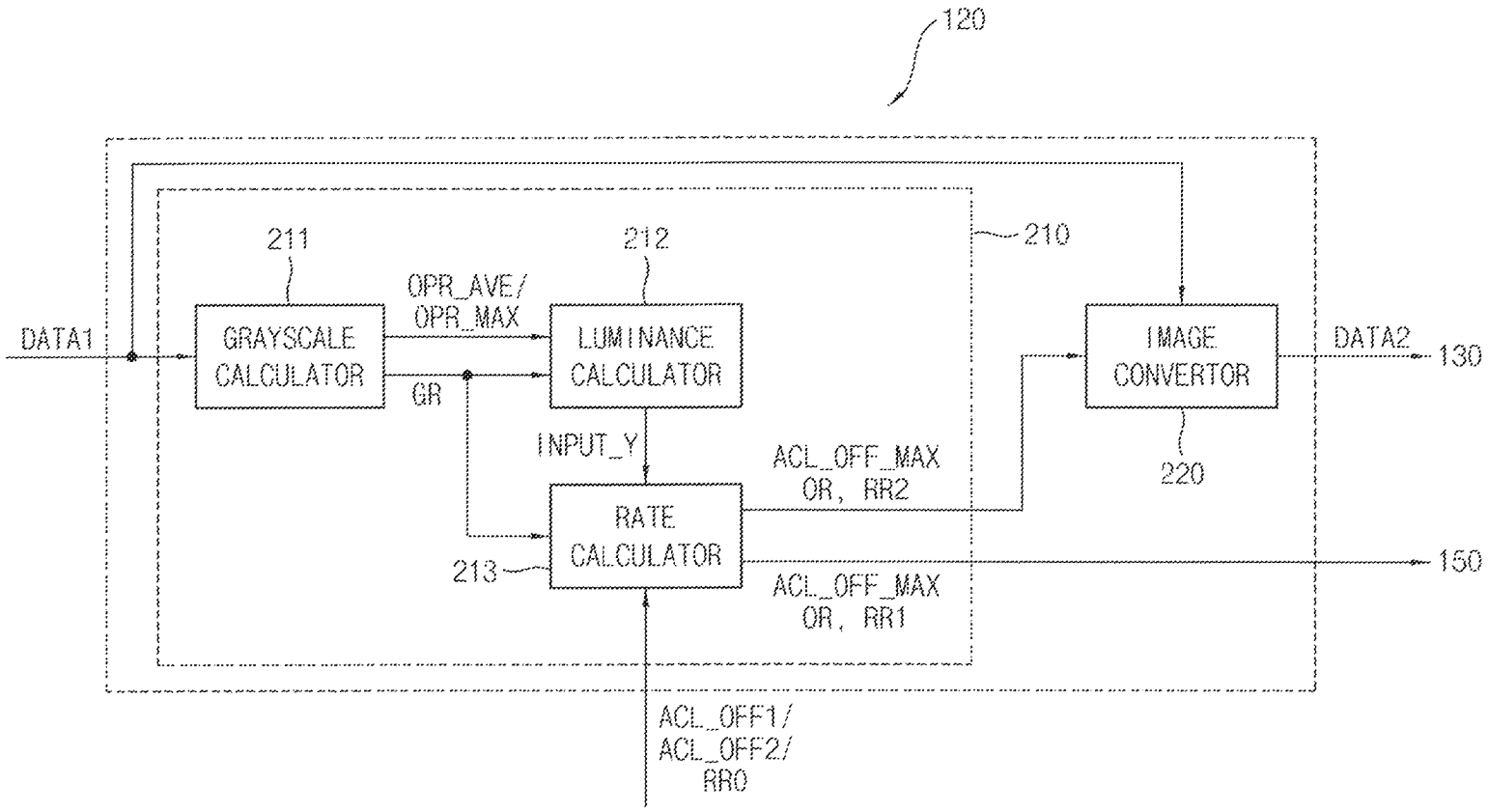
FIG. 2 is a block diagram illustrating an example of a timing controller included in the display device of FIG. 1.
Figure 3A:
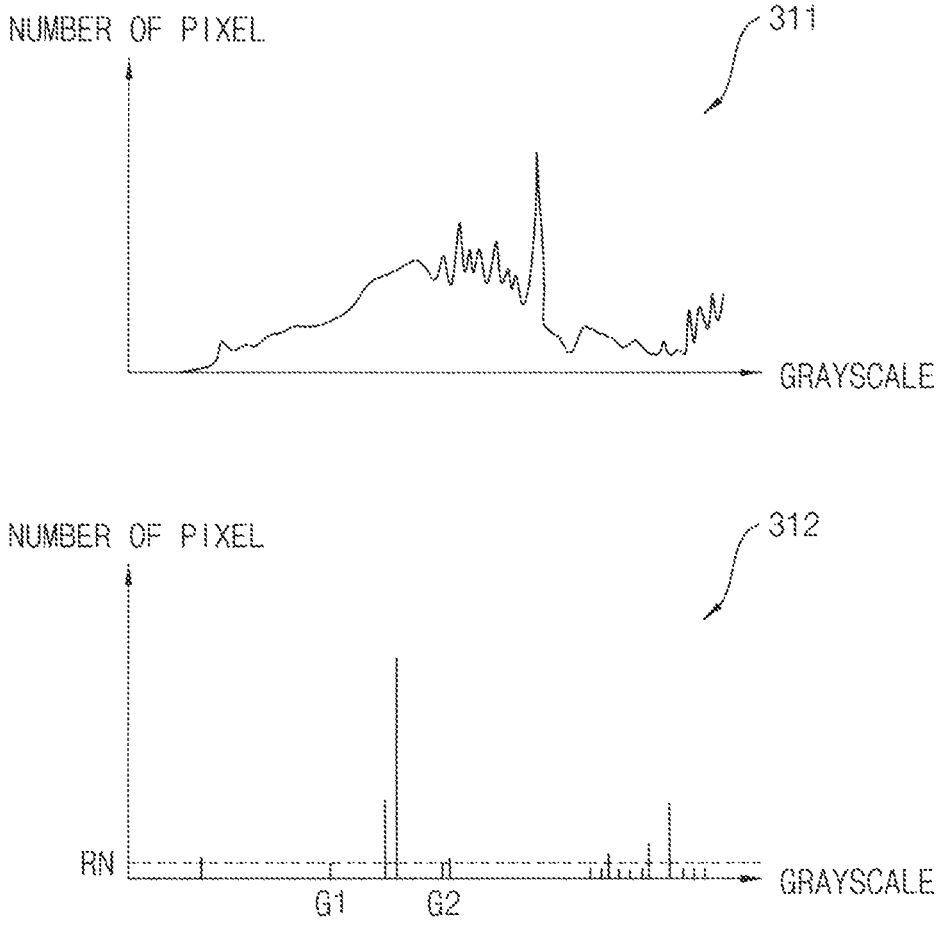
FIG. 3A is a diagram illustrating an example of a histogram of input data provided to the display device of FIG. 1.
Figure 3B:
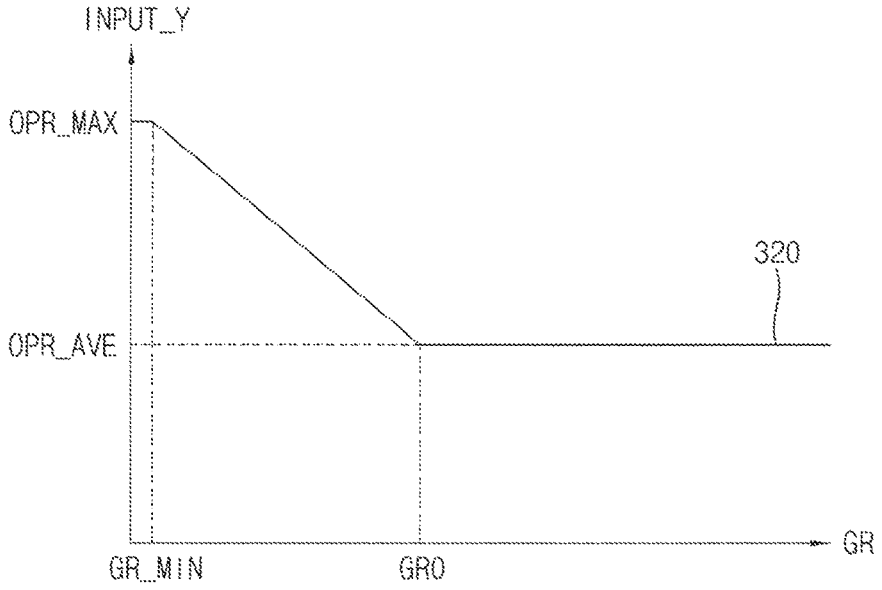
FIG. 3B is a diagram in which an input luminance is calculated by the timing controller of FIG. 2.
Figure 3C:
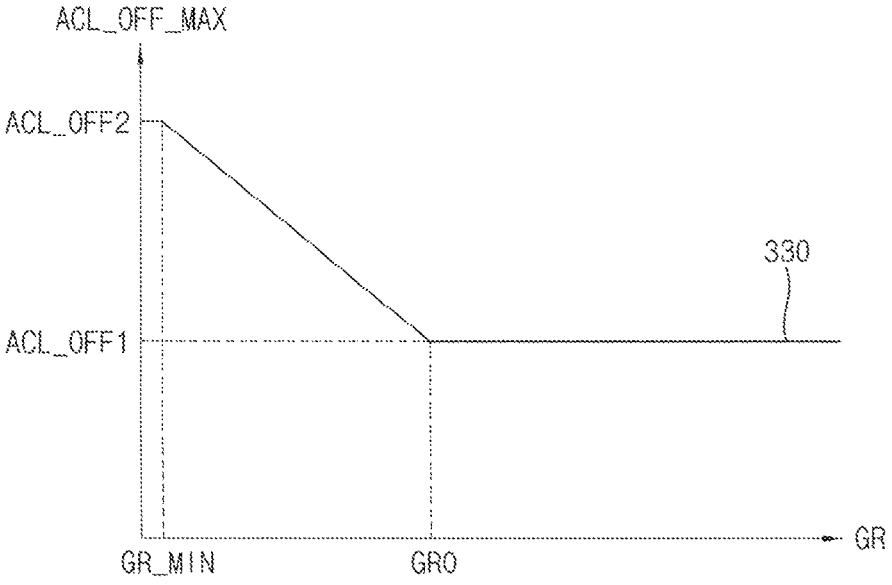
FIGS. 3C and 3D are diagrams in which an automatic-current-limit rate is calculated by the timing controller of FIG. 2.
Figure 3D:
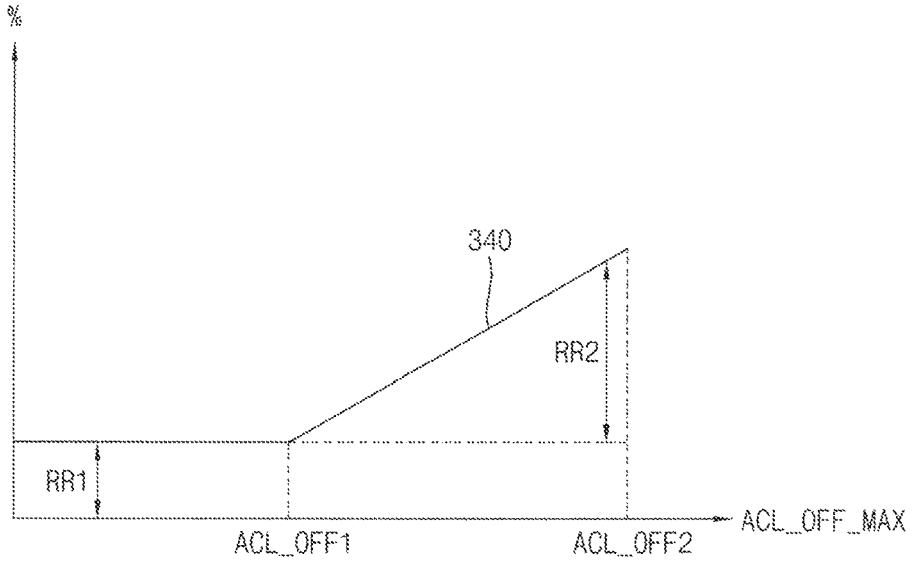
Figure 3E:
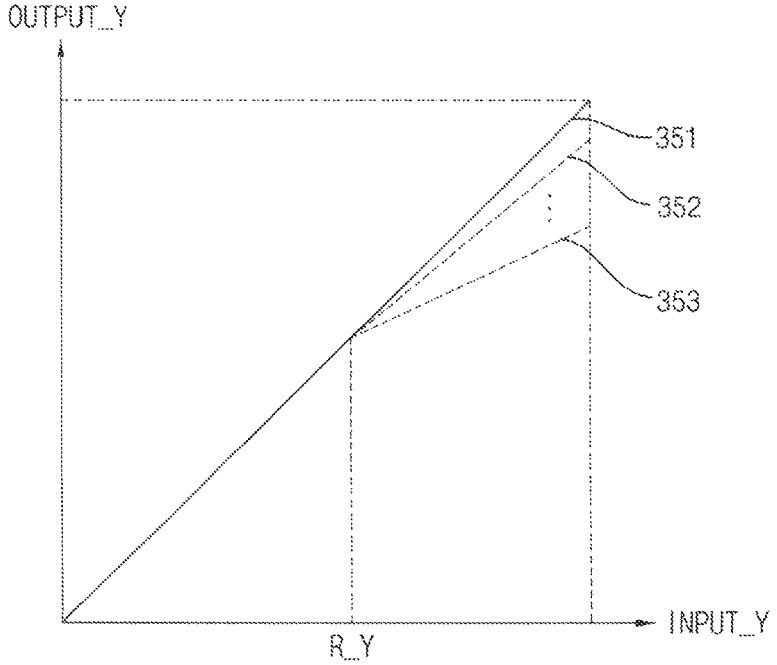
FIG. 3E is a diagram illustrating an example of output luminance calculated by the timing controller of FIG. 2.
Figure 3F:
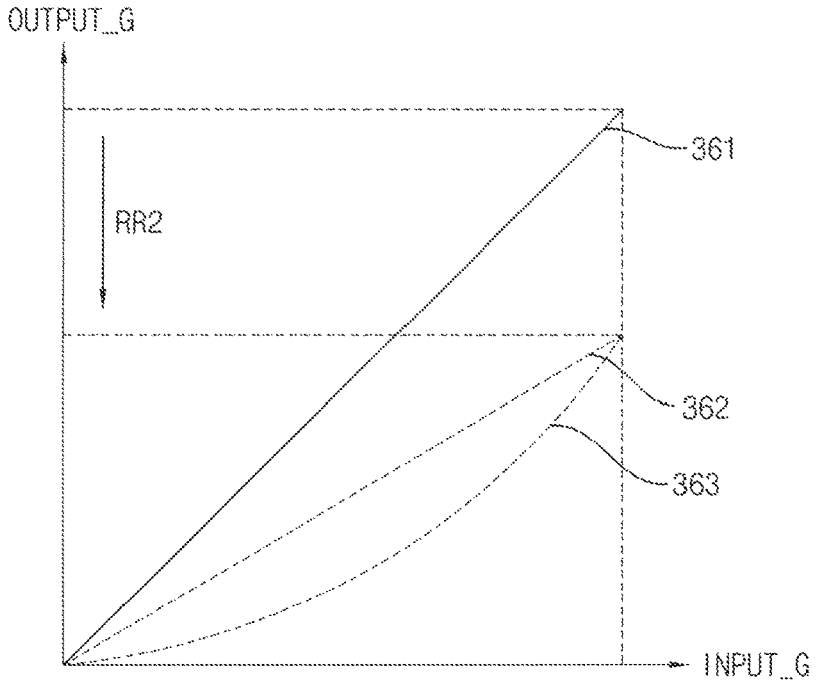
FIG. 3F is a diagram in which an input data is converted by the timing controller of FIG. 2.

FIG. 2 is a block diagram illustrating an example of a timing controller included in the display device of FIG. 1. FIG. 3A is a diagram illustrating an example of a histogram of input data provided to the display device of FIG. 1. FIG. 3B is a diagram in which an input luminance is calculated by the timing controller of FIG. 2. FIGS. 3C and 3D are diagrams in which an automatic-current-limit rate is calculated by the timing controller of FIG. 2. FIG. 3E is a diagram illustrating an example of output luminance calculated by the timing controller of FIG. 2. FIG. 3F is a diagram in which an input data is converted by the timing controller of FIG. 2.

Referring to FIG. 2, the timing controller 120 may include a calculator 210 and an image converter 220. The calculator 210 may include a grayscale calculator 211, a luminance calculator 212, and a rate calculator 213.

The grayscale calculator 211 may calculate a grayscale usage ratio GR of first data DATA1 and may calculate an average on-pixel ratio OPR_AVE and a maximum on-pixel ratio OPR_MAX of the first data DATA1 (or, input data).

Referring to FIG. 3A, a first histogram 311 may represent a grayscale distribution of first input data, and the first input data may be (or, correspond) a quality-first image (e.g., a landscape image, a portrait image, etc). According to the first histogram 311, the first input data may include about 80% of grayscale levels (e.g., grayscale levels in a range of 50 through 255 among a range of 0 through 255). In this case, the grayscale usage ratio GR of the first input data may be about 80% ((255−49)/255*100%)).

The average on-pixel ratio OPR_AVE and the maximum on-pixel ratio OPR_MAX of the first input data may be calculated based on a number of pixels for each of grayscale levels and driving currents for each of the grayscale levels. For example, the average on-pixel ratio OPR_AVE of the first input data may be about 80%, and the maximum on-pixel ratio OPR_MAX of the first input data may be about 80%.

A second histogram 312 may represent a grayscale distribution of second input data, and the second input data may be (or, correspond) an operation-first image (e.g., a text input screen, etc). The second input data may include only some grayscale levels of third color (e.g., about 10% of a blue color grayscale levels among red/green/blue color grayscale levels). In this case, the grayscale usage ratio GR of the second input data may be about 3.3% (10%/3).

The average on-pixel ratio OPR_AVE and the maximum on-pixel ratio OPR_MAX of the second input data may be calculated based on a number of pixels for each of grayscale levels and driving currents for each of the grayscale levels. For example, the maximum on-pixel ratio OPR_AVE of the second input data (e.g., an on-pixel ratio of the blue color) may be about 60%, and the average on-pixel ratio OPR_MAX of the second input data may be about 20%.

In some example embodiments, the grayscale calculator 211 may calculate the grayscale usage ratio GR by using only valid grayscale levels. Here, the valid grayscale levels may have a usage ratio greater than a reference value, and the usage ratio (or, the usage ratio of a certain grayscale level) may be a ratio of a number of pixels corresponding to a certain grayscale level to a total number of the pixels 111. That is, the grayscale calculator 211 may determine some grayscale levels of which number is less than the reference value (or, some grayscale levels of which a grayscale usage is less than the reference value) as noise and may not reflect the some grayscale levels on the grayscale usage ratio GR. For example, the reference value may be 0.03%.

For example, with reference to the second histogram 312, the grayscale calculator 211 may calculate the grayscale usage ratio GR excluding some pixels (e.g., some pixels corresponding to a first grayscale level G1 and a second grayscale level G2, etc) which have a value lower than a reference value RN. In this case, the grayscale usage ratio GR may be 1%.

An input luminance INPUT and a maximum automatic-current-limit rate ACL_OFF_MAX described below may have a value which increases as the grayscale usage ratio GR is reduced. Therefore, the grayscale calculator 211 may improve an effect for reducing the power consumption of an operation-first image by calculating the grayscale usage ratio GR of the operation-first image such as the second input data.

Referring to FIG. 2 again, the luminance calculator 212 may calculate an input luminance INPUT_Y of the first data DATA1 based on the average on-pixel ratio OPR_AVE and the maximum on-pixel ratio OPR_MAX.

In some example embodiments, the luminance calculator 212 may calculate the input luminance INPUT_Y based on the average on-pixel ratio OPR_AVE when the grayscale usage ratio GR of the first data DATA1 is equal to or greater than a reference grayscale usage ratio GR0 and may calculate the input luminance INPUT_Y based on the average on-pixel ratio OPR_AVE and the maximum on-pixel ratio OPR_MAX when the grayscale usage ratio GR of the first data DATA1 is less than the reference grayscale usage ratio GR0. For example, the luminance calculator 212 may calculate the input luminance INPUT_Y by interpolating the average on-pixel ratio OPR_AVE and the maximum on-pixel ratio OPR_MAX based on the reference grayscale usage ratio GR0. Here, the input luminance INPUT_Y may be represented as a ratio of a luminance corresponding to the first data to a maximum luminance (e.g., 300 nits) of the display device 100. For example, the input luminance INPUT_Y may be proportional to or equal to a result of interpolating the average on-pixel ratio OPR_AVE and the maximum on-pixel ratio OPR_MAX.

Referring to FIG. 3B, a first curve 320 may represent the input luminance INPUT_Y which is calculated by interpolating the average on-pixel ratio OPR_AVE and the maximum on-pixel ratio OPR_MAX based on the grayscale usage ratio GR.

According to the first curve 320, a weight of the average on-pixel ratio OPR_AVE may be 100% and a weight of the maximum on-pixel ratio OPR_MAX may be 0% when the grayscale usage ratio GR is greater than or equal to the reference grayscale usage ratio GR0. Here, the reference grayscale usage ratio may be 30%. That is, the luminance calculator 212 may calculate the input luminance INPUT_Y based on the average on-pixel ratio OPR_AVE when the grayscale usage ratio GR is greater than or equal to the reference grayscale usage ratio GR0. For example, the input luminance INPUT_Y may be equal to the average on-pixel ratio OPR_AVE when the grayscale usage ratio GR is greater than or equal to the reference grayscale usage ratio GR0.

When the grayscale usage ratio GR is less than the reference grayscale usage ratio GR0, a weight of the average on-pixel ratio OPR_AVE may be linearly reduced from 100% and a weight of the maximum on-pixel ratio OPR_MAX may linearly increases from 0% as the grayscale usage ratio GR is reduced. That is, the luminance calculator 212 may calculate the input luminance INPUT_Y considering the average on-pixel ratio OPR_AVE and the maximum on-pixel ratio OPR_MAX. For example, the input luminance INPUT_Y may be proportional to or equal to the result of interpolating the average on-pixel ratio OPR_AVE and the maximum on-pixel ratio OPR_MAX when the grayscale usage ratio GR is less than the reference grayscale usage ratio GR0.

When the grayscale usage ratio GR is less than a minimum reference grayscale usage ratio GR_MIN, the weight of the average on-pixel ratio OPR_AVE may be 0% and the weight of the maximum on-pixel ratio OPR_MAX may be 100%. Here, the minimum reference grayscale usage ratio GR_MIN may be 0.3%. That is, the luminance calculator 21 may calculate the input luminance INPUT_Y based on the maximum on-pixel ratio OPR_MAX. For example, the input luminance INPUT_Y may be proportional to or equal to the maximum on-pixel ratio OPR_MAX.

For example with reference to FIG. 3A, the luminance calculator 212 may calculate the input luminance INPUT_Y based on the average on-pixel ratio OPR_AVE, which is 80%, of the first input data, because the grayscale usage ratio GR of the first input data is 80%. In this case, the input luminance INPUT_Y may be 80%. For example, the luminance calculator 212 may calculate the input luminance INPUT_Y by interpolating the average on-pixel ratio OPR_AVE of the second input data, which is 20%, and the maximum on-pixel ratio OPR_MAX of the second input data, which is 60%, based on the first curve 320 because the grayscale usage ratio GR of the second input data is 3.3%. In this case, the input luminance INPUT_Y may be 50%.

That is, the luminance calculator 212 (or, the timing controller 120, the display device 100) may calculate the input luminance INPUT_Y of the second input data (or, an operation-first image) relatively high by interpolating the average on-pixel ratio OPR_AVE and the maximum on-pixel ratio OPR_MAX instead of by using only the average on-pixel ratio OPR_AVE.

Referring to FIG. 2 again, the rate calculator 213 may calculate the maximum automatic-current-limit rate ACL_OFF_MAX based on the grayscale usage ratio GR.

In some example embodiments, the rate calculator 213 may determine the maximum automatic-current-limit rate ACL_OFF_MAX to be equal to a first reference rate ACL_OFF1 when the grayscale usage ratio GR is greater than or equal to the reference grayscale usage ratio and may determine the maximum automatic-current-limit rate ACL_OFF_MAX based on the first reference rate ACL_OFF1 and a second reference rate ACL_OFF2 when the grayscale usage ratio GR is less than the reference grayscale usage ratio. For example, the rate calculator 213 may determine the maximum automatic-current-limit rate by interpolating the first reference rate ACL_OFF1 and the second reference rate ACL_OFF2. Here, the second reference rate ACL_OFF2 may be greater than the first reference rate ACL_OFF1. For example, the first reference rate ACL_OFF1 may be 8%, and the second reference rate ACL_OFF2 may be 25%.

Referring to FIG. 3C, a second curve 330 may represent the maximum automatic-current-limit rate ACL_OFF_MAX according to the grayscale usage ratio GR. According to the second curve 330, the maximum automatic-current-limit rate ACL_OFF_MAX may be the first reference rage ACL_OFF1 when the grayscale usage GR is greater than or equal to the reference grayscale usage ratio GR0, and the maximum automatic-current-limit rate ACL_OFF_MAX may be equal to a result of interpolating the first reference rate ACL_OFF1 and the second reference rate ACL_OFF2 when the grayscale usage ratio GR is less than the reference grayscale usage ratio GR0. The maximum automatic-current-limit rate ACL_OFF_MAX may be equal to the second reference rate ACL_OFF2 when the grayscale usage ratio GR is less than or equal to a minimum reference grayscale usage ratio GR_MIN.

In some example embodiments, the rate calculator 213 may calculate a first reduction rate RR1 and a second reduction rate RR2 based on the maximum automatic-current-limit rate ACL_OFF_MAX (or, an automatic-current-limit rate), where the first reduction rate RR1 is to reduce the on-duty (or, an on-duty rate) of the pixels 111, and the second reduction rate RR2 is to reduce (or, downscale) the first data DATA1. A sum of the first reduction rate RR1 and the second reduction rate RR2 may be equal to the maximum automatic-current-limit rate ACL_OFF_MAX.

Referring to FIG. 3D, a third curve 340 may represent the first reduction rate RR1 and the second reduction rate RR2 according to the maximum automatic-current-limit rate ACL_OFF_MAX.

The first reduction rate RR1 may have a constant value independent of change of the maximum automatic-current-limit rate ACL_OFF_MAX. For example, the first reduction rate RR1 may be equal to the first reference rate ACL_OFF1 (e.g., 8%) described with reference to FIG. 3C.

The second reduction rate RR2 may be equal to an excess-rate when the maximum automatic-current-limit rate ACL_OFF_MAX excesses a reference reduction rate (or, the first reduction rate RR1, the first reference rate ACL_OFF1) by the excess-rate. That is, the second reduction rate RR2 may be 0% when the maximum automatic-current-limit rate ACL_OFF_MAX is less than the first reference rate ACL_OFF1 and may be equal to a difference between the maximum automatic-current-limit rate ACL_OFF_MAX and the first reference rate ACL_OFF1 when the maximum automatic-current-limit rate ACL_OFF_MAX is greater than or equal to the first reference rate ACL_OFF1. The second reduction rate RR2 may have a maximum value when the maximum automatic-current-limit rate ACL_OFF_MAX is equal to the second reference rate ACL_OFF2.

In some example embodiments, the rate calculator 213 (or, the timing controller 120) may determine the maximum automatic-current-limit rate ACL_OFF_MAX based on a user limit rate RR0. Here, the user limit rate RR0 may be provided from an external device or a user. For example, the rate calculator 213 may determined the maximum automatic-current-limit rate ACL_OFF_MAX to be equal to 10% when the rate calculator 213 receives the user limit rate RR0 of 10%.

In some example embodiments, the rate calculator 213 (or, the timing controller 120) may calculate an output luminance OUTPUT_Y of the first data DATA1 based on the input luminance INPUT_Y and the maximum automatic-current-limit rate ACL_OFF_MAX. For example, the rate calculator 213 may calculate the output luminance OUTPUT_Y by reducing the input luminance INPUT_Y based on the maximum automatic-current-limit rate ACL_OFF_MAX when the input luminance INPUT_Y is greater than or equal to a reference luminance R_Y.

Referring to FIG. 3E, a first luminance curve 351 may represent a relation between the input luminance INPUT_Y and the output luminance OUTPUT_Y when the maximum automatic-current-limit rate ACL_OFF_MAX is 0%. In this case, the output luminance OUTPUT_Y may be equal to the input luminance INPUT_Y.

A second luminance curve 352 may represent a relation between the input luminance INPUT_Y and the output luminance OUTPUT_Y when the maximum automatic-current-limit rate ACL_OFF_MAX is equal to the first reference rate ACL_OFF1. According to the second luminance curve 352, the output luminance OUTPUT_Y may be equal to the reference luminance R_Y when the input luminance INPUT_Y is less than the reference luminance R_Y and may be less than the input luminance INPUT_Y when the input luminance INPUT_Y is greater than or equal to the reference luminance R_Y. Here, the reference luminance R_Y may represent a base (or, reference) for reducing the power consumption. For example, the reference luminance R_Y may be about 30% (e.g., a luminance corresponding to about 30% of a maximum luminance). For example, the rate calculator 213 may calculate the output luminance OUTPUT_Y by reducing the input luminance INPUT_Y based on the maximum automatic-current-limit rate ACL_OFF_MAX (or, the first reference rate ACL_OFF1). In this case, the rate calculator 213 (or, the timing controller 120) may output only the first reduction rate RR1.

Similarly, a third luminance curve 353 may represent a relation between the input luminance INPUT_Y and the output luminance OUTPUT_Y when the maximum automatic-current-limit rate ACL_OFF_MAX is equal to the second reference rate ACL_OFF2. According to the third luminance curve 353, the output luminance OUTPUT_Y may be equal to the reference luminance R_Y when the input luminance INPUT_Y is less than the reference luminance R_Y and may be less than the input luminance INPUT_Y when the input luminance INPUT_Y is greater than or equal to the reference luminance R_Y. For example, the rate calculator 213 may calculate the output luminance OUTPUT_Y by reducing the input luminance INPUT_Y based on the maximum automatic-current-limit rate ACL_OFF_MAX (or, the second reference rate ACL_OFF2). In this case, the rate calculator 213 (or, the timing controller 120) may output the first reduction rate RR1 and the second reduction rate RR2.

That is, the rate calculator 213 (or, the timing controller 120) may determine that reducing the power consumption is not needed when the input luminance INPUT_Y is less than the reference luminance R_Y, and the display device 100 may display an image with the output luminance OUTPUT_Y which is equal to the input luminance INPUT_Y. In addition, the rate calculator 213 (or, the timing controller 120) may determine that reducing the power consumption is needed when the input luminance INPUT_Y is greater than or equal to the reference luminance R_Y and may calculate the output luminance OUTPUT_Y by reducing the input luminance INPUT_Y based on the maximum automatic-current-limit rate ACL_OFF_MAX. In this case, the display device 100 may display an image with the output luminance OUTPUT_Y which is less than the input luminance INPUT_Y.

As described with reference to FIGS. 3A and 3B, the input luminance INPUT_Y of the input data may be 20% when a display device calculates the input luminance INPUT_Y based on only the average on-pixel ratio OPR_AVE. Therefore, the display device may not display an image corresponding to the second image data based on the first luminance curve 351. That is, the power consumption of the second image data will not be reduced.

The display device 100 according to example embodiments may calculate the input luminance INPUT_Y based on the average on-pixel ratio OPR_AVE and the maximum on-pixel ratio OPR_MAX. Therefore, the input luminance INPUT_Y of the second input data may be 50%. In this case, the display device 100 may display an image corresponding to the second input data based on the third luminance curve 353 (or, a luminance curve between the second luminance curve 352 and the third luminance curve 353) because the input luminance INPUT_Y is greater than the reference luminance R_Y (e.g., 30%). That is, the display device 100 may reduce the power consumption for the second input data.

Referring to FIG. 2 again, the image convertor 220 may generate second data DATA2 by reducing (or, by downscaling) the first data DATA1 based on the second reduction rate RR2.

Referring to FIG. 3F, a first mapping curve 361 may represent a relation between an input grayscale level INPUT_G and an output grayscale level OUTPUT_G when the second reduction rate RR2 is less than a reference value (e.g., 0). According to the first mapping curve 361, the output grayscale level OUTPUT_G may be equal to the input grayscale level INPUT_G.

A second mapping curve 362 may represent a relation between the input grayscale level INPUT_G and the output grayscale level OUTPUT_G when the second reduction rate RR2 is greater than the reference value (e.g., 0), and the output grayscale level OUTPUT_G may be linear to (or, proportional to) the input grayscale level INPUT_G. According to the second mapping curve 362, the output grayscale level OUTPUT_G may have a value which is reduced with respect to the input grayscale level INPUT_G by the second reduction rate RR2.

A third mapping curve 363 may represent a relation between the input grayscale level INPUT_G and the output grayscale level OUTPUT_G when the second reduction rate RR2 is greater than the reference value (e.g., 0), and the output grayscale level OUTPUT_G may not be proportional to the input grayscale level INPUT_G. For example, the second mapping curve 362 may correspond to a gamma curve 2.2, and the third mapping curve 363 may correspond to a gamma curve 2.4. That is, a gamma characteristic of the display device 100 using the third mapping curve 363 may correspond to the gamma curve 2.2.

The image convertor 200 may increase an image contrast of the first data DATA1 and improve visual luminance by converting the first data DATA1 using the third mapping curve 363.

As described with reference to FIGS. 2, 3A through 3F, the timing controller (or, the display device 100) may calculate the grayscale usage ratio GR, the average on-pixel ratio OPR_AVE, and the maximum on-pixel ratio OPR_MAX of the first data DATA1 (or, input data), may calculate the input luminance INPUT_Y of the first data DATA1 based on the average on-pixel ratio OPR_AVE and the maximum on-pixel ratio OPR_MAX, may calculate the maximum automatic-current-limit rate ACL_OFF_MAX based on the grayscale usage ratio GR, and may calculate the output luminance OUTPUT_Y (or, an automatic-current-limit rate) for the first data DATA1 based on the input luminance INPUT_Y and the grayscale usage ratio GR. Therefore, the display device 100 may reduce the power consumption by displaying an image corresponding to the first data DATA1 with the output luminance OUTPUT_Y.

In addition, an effect of reducing the power consumption for the operation-first image (or, an image using one color or two colors) by calculating the input luminance INPUT_Y based on the average on-pixel ratio OPR_AVE and the maximum on-pixel ratio OPR_MAX.

Figure 3G:
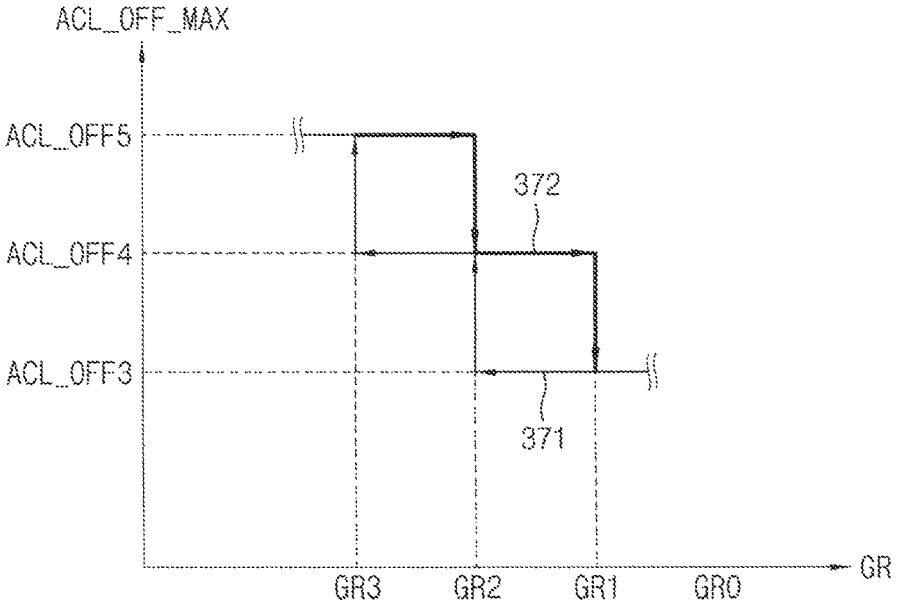
FIGS. 3G and 3H are diagrams in which an automatic-current-limit rate is changed by the timing controller of FIG. 2.
Figure 3H:
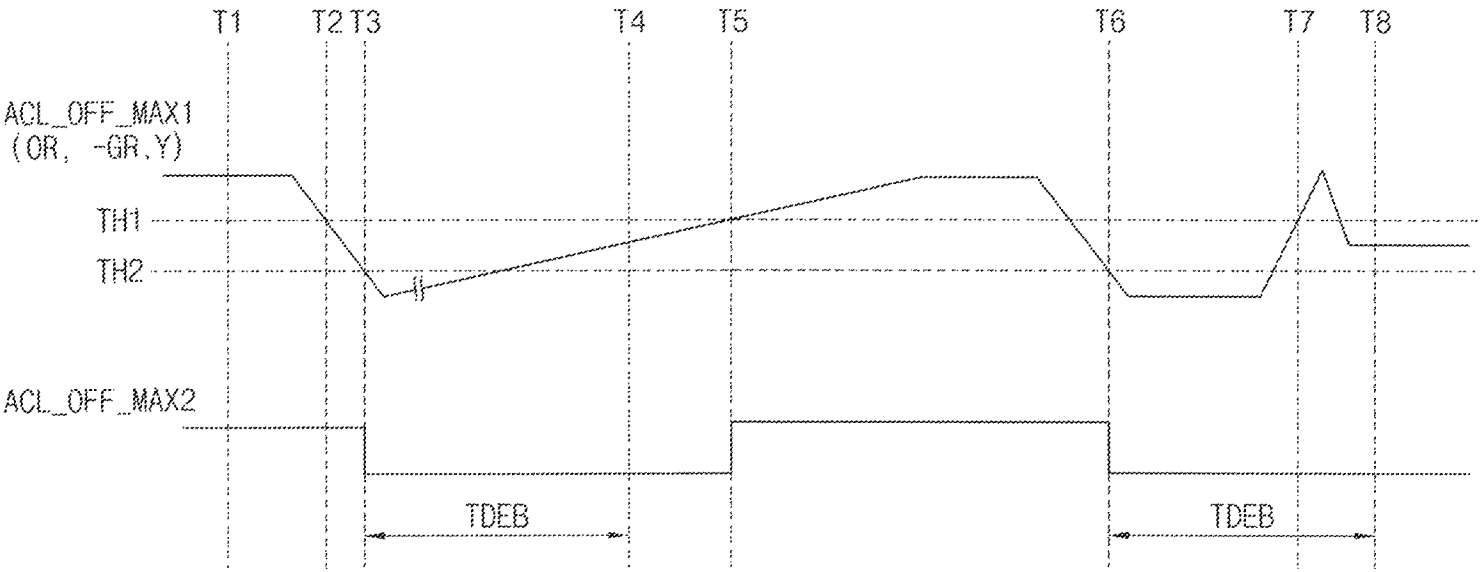

FIGS. 3G and 3H are diagrams in which an automatic-current-limit rate is changed by the timing controller of FIG. 2.

Referring to FIGS. 2, 3C, 3G, and 3H, the timing controller 120 (or, the rate calculator 213) may determined the maximum automatic-current-limit rate ACL_OFF_MAX to be decreased step-by-step according to increasing of the grayscale usage ratio GR, unlike the second curve 330 illustrated in FIG. 3C in which the maximum automatic-current-limit rate ACL_OFF_MAX is decreasing linearly.

A first rate curve 371 illustrated in FIG. 3G may represent the maximum automatic-current-limit rate ACL_OFF_MAX corresponding to grayscale regions. The grayscale regions (e.g., a region between the first and second grayscale usage ratios GR1~GR2, a region between the second and third grayscale usage ratios GR2~GR3) may be included in a range of the reference grayscale usage ratio GR0 and the minimum grayscale usage ratio GR_MIN described with reference to FIG. 3C, and each of the grayscale regions may be divided based on a predetermined threshold value. That is, the maximum automatic-current-limit rate ACL_OFF_MAX may be changed linearly depending on a change of the grayscale usage ratio according to the second curve 330 illustrated in FIG. 3C, or the maximum automatic-current-limit rate ACL_OFF_MAX may be changed step-by-step depending on a change of the grayscale usage ratio according to the first rate curve 371 in FIG. 3G.

Similarly to the first rate curve 371, a second rate curve 372 may represent the maximum automatic-current-limit rate ACL_OFF_MAX corresponding to the grayscale regions and may have a value greater than a value of the maximum automatic-current-limit rate ACL_OFF_MAX in the first rate curve 371. For example, in the first region (i.e., in a region between the first and second grayscale usage ratios GR1~GR2), the maximum automatic-current-limit rate ACL_OFF_MAX according to the first rate curve 371 may be equal to a third reference rate ACL_OFF3 and the maximum automatic-current-limit rate ACL_OFF_MAX according to the second rate curve 372 may be equal to a fourth reference rate ACL_OFF4. Similarly, in the second region (i.e., in a region between the second and third grayscale usage ratios GR2~GR3), the maximum automatic-current-limit rate ACL_OFF_MAX according to the first rate curve 371 may be equal to the fourth reference rate ACL_OFF4 and the maximum automatic-current-limit rate ACL_OFF_MAX according to the second rate curve 372 may be equal to a fifth reference rate ACL_OFF5. Here, the third reference rate ACL_OFF3 may be greater than the first reference rate ACL_OFF1 described with reference to FIG. 3C, and the fourth reference rate ACL_OFF4 may be greater than the third reference rate ACL_OFF3. The fifth reference rate ACL_OFF5 may be greater than the fourth reference rate ACL_OFF4 and may be less (or, smaller) than the second reference rate ACL_OFF2 described with reference to FIG. 3C.

In some example embodiments, the timing controller 120 (or, the rate calculator 213) may calculate the maximum automatic-current-limit rate ACL_OFF_MAX using a previous grayscale usage ratio of previous input data (e.g., a grayscale usage ratio of input data which is provided at a previous time) and the grayscale usage ratio GR of the first data DATA1 (or, current input data).

In some example embodiments, the timing controller 120 may determine a grayscale region corresponding to the previous grayscale usage ratio of the previous input data, may increase the maximum automatic-current-limit rate ACL_OFF_MAX when the grayscale usage ratio GR is less than a minimum value of the grayscale region, and may decrease the maximum automatic-current-limit rate ACL_OFF_MAX when the grayscale usage ratio GR is greater than a maximum value of the grayscale region by the threshold value.

That is, the maximum automatic-current-limit rate ACL_OFF_MAX may be changed along the first rate curve 371 when the grayscale usage ratio GR is less than the previous grayscale usage ratio, and the maximum automatic-current-limit rate ACL_OFF_MAX may be changed along the second rate curve 372 when the grayscale usage ratio GR is greater than the previous grayscale usage ratio.

For example, the maximum automatic-current-limit rate ACL_OFF_MAX may be fourth reference rate ACL_OFF4 when the previous grayscale usage ratio is less than the second grayscale usage ratio GR2 and greater than the third grayscale usage ratio GR3. Here, the maximum automatic-current-limit rate ACL_OFF_MAX may be changed to be the fifth reference rate ACL_OFF5 according to the first rate curve 371 when the grayscale usage ratio GR (i.e., a current grayscale usage ratio) is less than the third grayscale usage ratio GR3. Alternatively, the maximum automatic-current-limit rate ACL_OFF_MAX may be the fourth reference rate ACL_OFF4 according to the second rate curve 372 instead of the fifth reference rate ACL_OFF5 when the grayscale usage ratio GR (i.e., a current grayscale usage ratio) is greater than the second grayscale usage ratio GR2. Similarly, the maximum automatic-current-limit rate ACL_OFF_MAX may be changed from the fourth reference rate ACL_OFF4 to the third reference rate ACL_OFF3 according to the second rate curve 372 when the grayscale usage ratio GR is greater than the first grayscale usage ratio GR1.

Therefore, the timing controller 120 may prevent the maximum automatic-current-limit rate ACL_OFF_MAX changing rapidly according to change of the grayscale usage ratio GR.

In some example embodiments, the timing controller 120 (or, the rate calculator 213) may change the maximum automatic-current-limit rate ACL_OFF_MAX using a delay time TDEB.

Referring to FIGS. 3C, 3G, and 3H, a first maximum automatic-current-limit rate ACL_OFF_MAX1 according to the first curve 320 illustrated in FIG. 3C may be changed according to the change of the grayscale usage ratio GR in real-time. The second maximum automatic-current-limit rate ACL_OFF_MAX2 according to the first rate curve 371 and the second rate curve 372 illustrated in FIG. 3G may be changed step-by-step.

As illustrated in FIG. 3H, at a first time T1, the second maximum automatic-current-limit rate ACL_OFF_MAX2 may be the fourth reference rate ACL_OFF4. At a second time T2, the first maximum automatic-current-limit rate ACL_OFF_MAX1 may be reduced under a first threshold value TH1 (or, under the third reference rate ACL_OFF3), but the second maximum automatic-current-limit rate ACL_OFF_MAX2 may be maintained with fourth reference rate ACL_OFF4 according to the second rate curve 372.

At a third time T3, the second maximum automatic-current-limit rate ACL_OFF_MAX2 may be changed to be the third reference rate ACL_OFF3 according to the second rate curve 372 when the first maximum automatic-current-limit rate ACL_OFF_MAX1 is less than a second threshold value TH2 (or, the third reference rate ACL_OFF3).

In a third time T3 through a fourth time T4, the first maximum automatic-current-limit rate ACL_OFF_MAX1 may be changed, but the second maximum automatic-current-limit rate ACL_OFF_MAX may be maintained with the third reference rate ACL_OFF3 because the second maximum automatic-current-limit rate ACL_OFF_MAX2 is determined based on the delay time TDEB.

At a fifth time T5, the second maximum automatic-current-limit rate ACL_OFF_MAX2 may be changed to be the fourth reference rate ACL_OFF4 according to the rate curve 371 when the first maximum automatic-current-limit rate ACL_OFF_MAX1 is greater than the first threshold voltage TH1.

In a fifth time T5 through a sixth time T6, the second maximum automatic-current-limit rate ACL_OFF_MAX2 may be maintained with the fourth reference rate ACL_OFF4 because the first maximum automatic-current-limit rate ACL_OFF_MAX1 is changed but less than the second threshold value TH2.

At the sixth time T6, the second maximum automatic-current-limit rate ACL_OFF_MAX2 may be changed to be the third reference rate ACL_OFF3 because the first maximum automatic-current-limit rate ACL_OFF_MAX1 is less than the second threshold value TH2.

After this, at a seventh time T7, the first maximum automatic-current-limit rate ACL_OFF_MAX1 may be greater than the first threshold value TH1, but the second maximum automatic-current-limit rate ACL_OFF_MAX2 may be maintained with the third reference rate ACL_OFF3 because the seventh time T7 is within the delay time TDEB with respect to the sixth time T6. At a eighth time T8, which passes (or, exceeds) the delay time TDEB, the second maximum automatic-current-limit rate ACL_OFF_MAX2 may be maintained with the third reference rate ACL_OFF3 because the first maximum automatic-current-limit rate ACL_OFF_MAX1 is less than the first threshold value TH1.

As described with reference to FIGS. 3G and 3H, the timing controller 120 may decrease the maximum automatic-current-limit rate ACL_OFF_MAX according to increasing of the grayscale usage ratio GR. In addition, the timing controller 120 may determine the maximum automatic-current-limit rate ACL_OFF_MAX using the previous grayscale usage ratio, the threshold value (e.g., the first threshold value TH1 and the second threshold value TH2), and the delay time TDEB. Therefore, the display device 100 may prevent (remove) some problems (e.g., undershooting of a driving voltage, etc) due to a temporal change of the maximum automatic-current-limit rate ACL_OFF_MAX.

Figure 4:
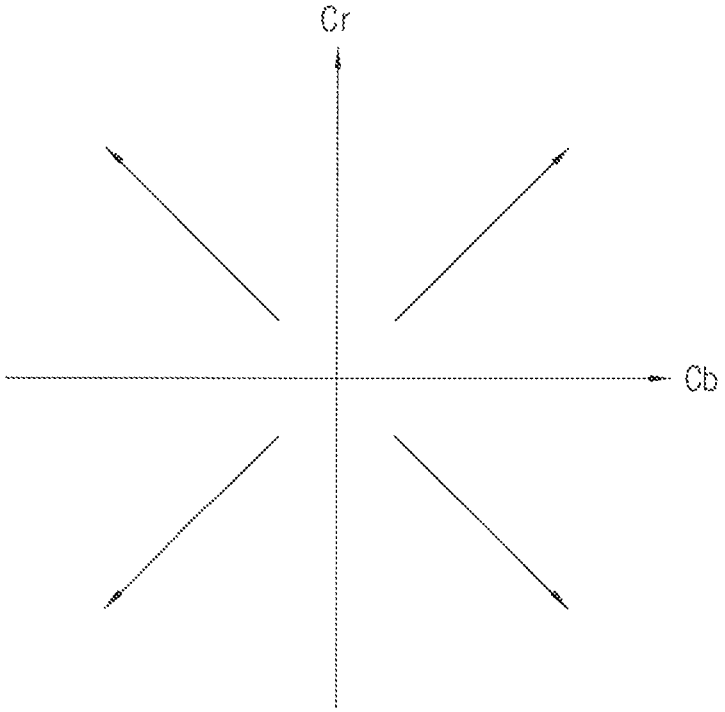
FIG. 4 is a diagram in which a chroma of an input data is improved by the timing controller of FIG. 2.

FIG. 4 is a diagram in which a chroma of an input data is improved by the timing controller of FIG. 2.

Referring to FIGS. 2 and 4, the timing controller 120 (or, the image convertor 220) may increase a chroma of the converted data (DATA 2, e.g., input data which is reduced based on the second reduction rate RR2). For reference, a first image having a relatively higher chroma may be visible (or, seen) to have a relatively higher luminance for a user, compared with a second image having a relatively lower chroma. Here, the first and second images may have the same luminance. That is, a visual luminance, which is visible for the user, may be higher as the chroma is higher. Therefore, the timing controller 120 may improve the visual luminance of the converted data by improving (or, by increasing) the chroma of the converted data.

In some example embodiments, the timing controller 120 (or, the image convertor 220) may convert the converted data (DATA2) in a RGB format into first converted data in a YCbCr format, may increase the chroma CbCr of the first converted data (and, may maintain a luminance Y of the first converted data) to generate a second converted data, and may generate third converted data in the RGB format by inversely converting (or, by reverse-converting, by inverse-converting) the first converted data having the increased chroma CbCr (or, second converted data). In this case, the timing controller 120 may provide the third converted data to the data driver 130 described with reference FIG. 1.

In an example embodiment, the timing controller 120 (or, the image convertor 220) may generate the first converted data using a [Equation 1] below, $$Y = 16 + \frac{65.738 * R}{256} + \frac{129.057 * G}{256} + \frac{25.064 * B}{256} \quad \text{[Equation 1]}$$

$$Cb = 128 - \frac{37.945 * R}{256} - \frac{74.494 * G}{256} + \frac{112.439 * B}{256}$$

$$Cr = 128 + \frac{112.439 * R}{256} - \frac{94.154 * G}{256} - \frac{18.285 * B}{256}$$

In an example embodiment, the timing controller 120 (or, the image convertor 220) may increase the chroma CbCr on a color difference coordinate illustrated in FIG. 4 to generate the second converted data. That is, the timing controller 120 (or, the image convertor 220) may increase absolute value (or, magnitude) of the chroma CbCr.

In an example embodiment, the timing controller 120 (or, the image convertor 220) may generate the third converted data using a [Equation 2] below, $$R' = \frac{255}{219}(Y - 16) + \frac{255}{112} * 0.701 * (Cr - 128) \quad \text{[Equation 2]}$$

$$G' = \frac{255}{219}(Y - 16) - \frac{255}{112} * 0.886 * \frac{0.114}{0.587} * (Cb - 128) - \frac{255}{112} * 0.701 * \frac{0.299}{0.587} * (Cr - 128)$$

$$G' = \frac{255}{219}(Y - 16) + \frac{255}{112} * 0.886 * (Cb - 128)$$

As described with reference to FIG. 4, the timing controller 120 (or, the image convertor 220) may improve the visual luminance, which is visible for the user, of the converted data by increasing the chroma of the converted data (e.g., input data which is reduced based on the second reduction rate RR2). Therefore, the timing controller 120 (or, the display device 100) may prevent luminance reduction (e.g., a relatively lower luminance of the converted data) due to image converting to be visible for the user.

Figure 5:
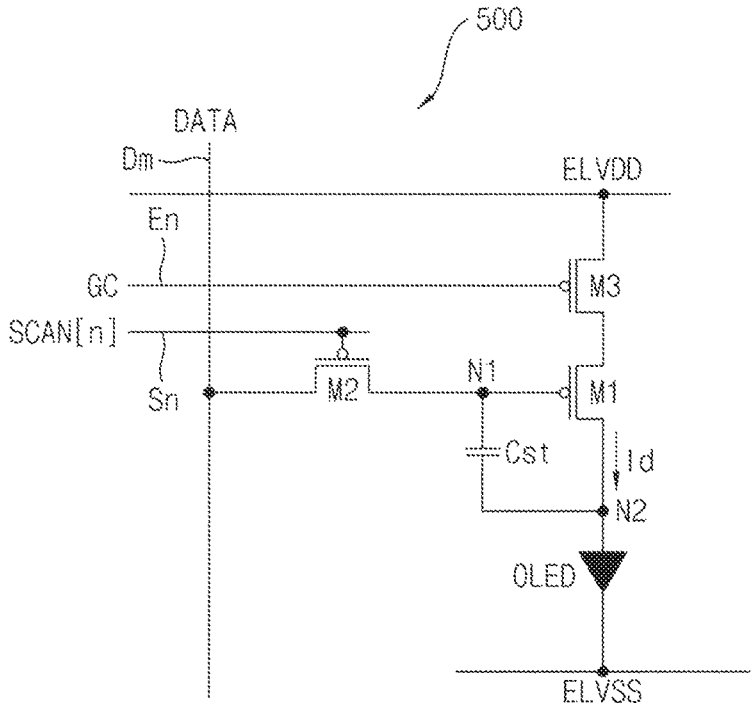
FIG. 5 is a circuit diagram illustrating an example of a pixel included in the display device of FIG. 1.
Figure 6:
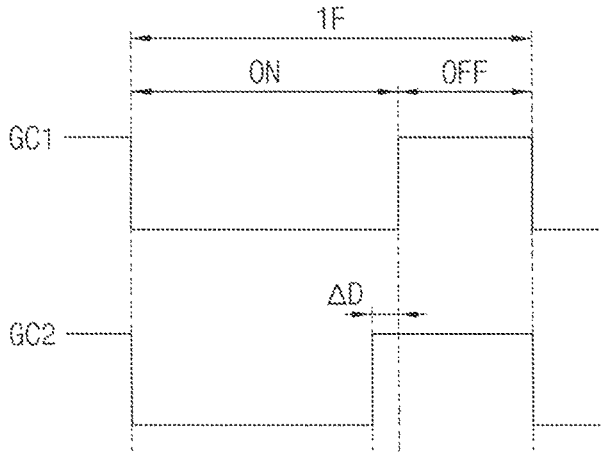
FIG. 6 is a waveform diagram illustrating an operation of an emission driver included in the display device of FIG. 1.

FIG. 5 is a circuit diagram illustrating an example of a pixel included in the display device of FIG. 1. FIG. 6 is a waveform diagram illustrating an operation of an emission driver included in the display device of FIG. 1.

Referring to FIGS. 1 and 5, a pixel 500 may include a first transistor M1, a second transistor M2, a third transistor M3, a storage capacitor Cst, and a light emission element OLED.

The second transistor M2 may be electrically connected between a data line and a first node N1 and may transfer the data signal DATA to the first node N1 in response to a gate signal SCAN[n]. Here, the gate signal SCAN[n] may be provided from the scan driver 140 through an n-th gate line Sn to the pixel 500, and the data signal DATA may be provided from the data driver 130 through an m-th data line Dm to the pixel 500. The storage capacitor Cst may be electrically connected between the first node N1 and the second node N2 and may store the data signal DATA temporally. The first transistor M1 may be electrically connected between the first power voltage ELVDD and a second node N2 and may be turned on/off in response to a first node voltage at the first node N1.

The third transistor M3 may be electrically connected between the first power voltage ELVDD and the first transistor M1 and may be turned on/off in response to a light emission control signal GC. Here, the light emission control signal GC may be provided from the emission driver 150 through an n-th light emission control signal line En to the pixel 500. The third transistor M3 may be turned on in response to the light emission control signal GC having the logic low level (or, a low voltage, a low voltage level, a turn-on voltage), and the first transistor M1 may transfer a driving current Id to the light emission element OLED in response to the data signal DATA stored in the storage capacitor Cst. The light emission element OLED may be electrically connected between a second node N2 and the second power voltage ELVSS and may emit light in response to the driving current Id.

That is, the pixel 500 may emit light or no light in response to logic levels of the light emission control signal GC.

Referring to FIG. 6, a first light emission control signal GC1 may be the light emission control signal GC generated by the emission driver 150 when the display device 100 do not employ the automatic current limit technique and a second light emission control signal GC2 may be the light emission control signal GC generated by the emission driver 150 when the display device 100 employs the automatic current limit technique.

The first light emission control signal GC1 may include a logic low level and a logic high level during a frame 1F, where the logic low level corresponds to the on-duty ON and the logic high level corresponds to the off-duty OFF. For example, the pixel 500 may store the data signal DATA when the first light emission control signal GC1 has the logic high level and may emit a light in response to the data signal DATA when the first light emission control signal GC1 has the logic low level.

An on duty ON of the second light emission control signal GC2 may be relatively shorter than that of the first light emission control signal GC1. Here, a difference AD between an on-duty ON corresponding to the first light emission control signal GC1 and an on-duty ON corresponding to the second light emission control signal GC2 may be proportional to the first reduction rate RR1 described with reference to FIG. 3D. That is, the emission driver 150 may generate the second light emission control signal GC2 by reducing the first light emission control signal GC1 by the first reduction rate RR1.

As described with reference to FIGS. 5 and 6, the pixel 500 may emit a light or no light in response to the light emission control signal GC, and the emission driver 150 may reduce the on-duty (or, a light emission time) of the pixel 500 based on the first reduction rate RR1. Therefore, luminance and power consumption may be reduced.

FIG. 7 is a diagram illustrating an example of power consumption of the display device of FIG. 1.

Referring to FIG. 7, power consumption of a conventional display device and power consumption of the display device 100 according to example embodiments may be illustrated for each of images. The conventional display device may employ (or, use) only image converting method.

A first image IMAGE1 may have a full-white pattern and may be an operation-first image. For example, the conventional display device may calculate on-pixel ratio OPR (or, an average on-pixel ratio OPR_AVE) of the first image IMAGE1 to be 100%, may determine the automatic-current-limit rate ACL to be equal to maximum automatic-current-limit rate ACL_OFF_MAX (or, the first reference rate described with reference FIG. 3C) of 8%, which is predetermined, and may convert the first image IMAGE1 based on the automatic-current-limit rate ACL. In this case, a maximum grayscale level V255 may be remapped to a grayscale level of 246, and the power consumption may be 1,371 milliwatts (mW).

On the other hand, the display device 100 according to example embodiments may determine the maximum automatic-current-limit rate ACL_OFF_MAX to be 25% according to the second curve 330 described with reference to FIG. 3C because a grayscale usage ratio of the first image IMAGE1 is about 0.4% (e.g., 1/255*100%). The display device 100 may determine the first reduction rate RR1 to be 8% according to the third curve 340 described with reference to FIG. 3D and may determine the second reduction rate RR2 to be 17%. In this case, the maximum grayscale level V255 may be remapped to a grayscale level of 234, and the on-duty for impulsive dimming driving (AID) may be reduced to be equal to 0.92 (or, 92%) of a reference on-duty. Therefore, the power consumption of the display device 100 may be 1,166 mW and may be reduced by 15% with respect to the power consumption of the conventional display device.

A second image IMAGE2 may have a full-blue pattern and may be an operation-first image. For example, the conventional display device may calculate on-pixel ratio OPR of the second image IMAGE2 to be 33% and may determine the automatic-current-limit rate ACL to be 0% because the on-pixel ratio OPR (or, an input luminance INPUT_Y corresponding to the on-pixel ratio OPR) is lower than a reference value (or, the reference luminance R_Y). In this case, the maximum grayscale level V255 may be maintained with a grayscale level of 255, and the power consumption may be 700 W.

For example, the display device 100 may calculate the input luminance INPUT_Y based on the maximum on-pixel ratio OPR_MAX (e.g., 100%) of the second image IMAGE2 according to the first curve 320 described with reference to FIG. 3B because a grayscale usage ratio of the second image IMAGE2 is about 0.4% (e.g., 1/255*100%). The display device 100 may determine the maximum automatic-current-limit rate ACL_OFF_MAX to be 25% according to the second curve 330 described with reference to FIG. 3C. The display device 100 may determine the first reduction rate RR1 to be 8% according to the third curve 340 described with reference to FIG. 3D and may determine the second reduction rate RR2 to be 17%. In this case, the maximum grayscale level V255 may be remapped to a grayscale level of 234, and the on-duty for impulsive dimming driving (AID) may be reduced to be equal to 0.92 (or, 92%) of a reference on-duty. Therefore, the power consumption of the display device 100 may be 552 mW and may be reduced by 21% with respect to the power consumption of the conventional display device.

A third image IMAGE3 may be an exemplary image of a text input screen and may be an operation-first image. For example, the conventional display device may calculate on-pixel ratio OPR of the third image IMAGE3 to be 87%, may determine the automatic-current-limit rate ACL to be 5.5% based on the on-pixel ratio OPR and the maximum automatic-current-limit rate ACL_OFF_MAX of 8%, which is predetermined, and may convert the third image IMAGE3 based on the automatic-current-limit rate ACL. In this case, the maximum grayscale level V255 may be maintained with a grayscale level of 249, and the power consumption may be 1,137 mW.

For example, the display device 100 may calculate the input luminance INPUT_Y based on the maximum on-pixel ratio OPR_MAX (e.g., 90%) of the third image IMAGE3 by interpolating the average on-pixel ratio OPR_AVE and the maximum on-pixel ratio OPR_MAX of the third image IMAGE3 according to the first curve 320 described with reference to FIG. 3B. The display device 100 may determine the maximum automatic-current-limit rate ACL_OFF_MAX to be 20% according to the second curve 330 described with reference to FIG. 3C. The display device 100 may determine the first reduction rate RR1 to be 6% according to the third curve 340 described with reference to FIG. 3D and the second luminance curve 352 (or, a luminance curve between the first luminance curve 351 and the second luminance curve 352) described with reference to FIG. 3E and may determine the second reduction rate RR2 to be 14%. In this case, the maximum grayscale level V255 may be remapped to a grayscale level of 243, and the on-duty for impulsive dimming driving (AID) may be reduced to be equal to 0.94 (or, 94%) of a reference on-duty. Therefore, the power consumption of the display device 100 may be 1,003 mW and may be reduced by 9% with respect to the power consumption of the conventional display device.

A fourth image IMAGE4 may be a portrait image and may be a quality-first image. For example, the conventional display device may calculate on-pixel ratio OPR of the fourth image IMAGE4 to be 78%, may determine the automatic-current-limit rate ACL to be 3.7% based on the on-pixel ratio OPR and the maximum automatic-current-limit rate ACL_OFF_MAX of 8%, which is predetermined, and may convert the fourth image IMAGE4 based on the automatic-current-limit rate ACL. In this case, the maximum grayscale level V255 may be maintained with a grayscale level of 251, and the power consumption may be 921 mW.

For example, the display device 100 may calculate the input luminance INPUT_Y (e.g., 78%) based on a grayscale usage ratio (e.g., 70%) of the fourth image IMAGE4 and the average on-pixel ratio OPR_AVE of the fourth image IMAGE4 according to the first curve 320 described with reference to FIG. 3D. The display device 100 may determine the maximum automatic-current-limit rate ACL_OFF_MAX to be 3.7% according to the second curve 330 described with reference to FIG. 3C. The display device 100 may determine the first reduction rate RR1 to be about 4% (or, 3.7%) according to the third curve 340 described with reference to FIG. 3D and the first luminance curve 351 described with reference to FIG. 3E and may determine the second reduction rate RR2 to be 0%. In this case, the maximum grayscale level V255 may be maintained with a grayscale level of 255, and the on-duty for impulsive dimming driving (AID) may be reduced to be equal to 0.96 (or, 96%) of a reference on-duty. Therefore, the power consumption of the display device 100 may be 926 mW and may be increased by 0.5% with respect to the power consumption of the conventional display device.

As described with reference to FIG. 7, the display device 100 may reduce the power consumption for operation-first images (e.g., the first through third imaged IMAGE1 through IMAGE3) compared with the conventional display device. In addition, the display device 100 may prevent distortion of image by employing no image conversion for a quality-first image (e.g., the fourth image IMAGE4) and may reduce the power consumption with efficiency similar to that of the conventional display device by using the impulsive dimming driving (AID) method.

Figure 8:
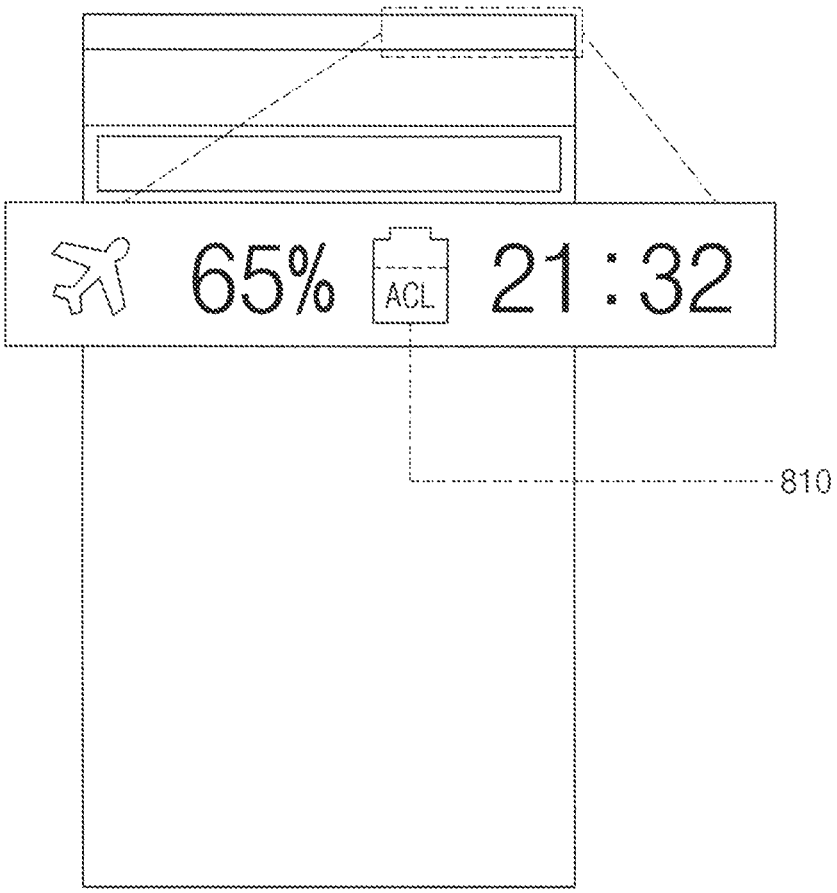
FIG. 8 is a diagram illustrating an example of a graphic user interface used in the display device of FIG. 1.

FIG. 8 is a diagram illustrating an example of a graphic user interface used in the display device of FIG. 1.

Referring to FIGS. 1 and 8, the display device 100 may further include a graphic user interface (GUI). Here, the graphic user interface may be used to control driving modes of the display device 100, where the driving modes of the display device 100 includes a normal driving mode and a power saving driving mode (or, an automatic-current-limit mode). In the power saving driving mode, the timing controller 120 may calculate an automatic-current-limit rate (i.e., the display device 100 may reduce power consumption employing (or, using) the automatic-current-limit technique). In the normal driving mode, the display device 100 may display an image without power saving (or, without reducing power consummation).

For example, the graphic user interface may be displayed as an icon 810 on one side of the display device 100, where the icon 810 represents the power saving driving mode. For example, the icon 810 may include battery shape and characters such as "ACL". In this case, a user may recognize that the display device 100 is driven in the power saving driving mode when the icon 810 is displayed. In addition, the display device 100 may allow a touch input through the icon 810 and may switch from the power saving driving mode to the normal driving mode. In the normal driving mode, the characters such as "ACL" may not be displayed on the icon 810.

As described with reference to FIG. 8, the display device 100 may notify whether power consumption of the display device 100 is reduced or not and may perform to mode switching based on input (or, input signal) through the graphic user interface.

Figure 9:
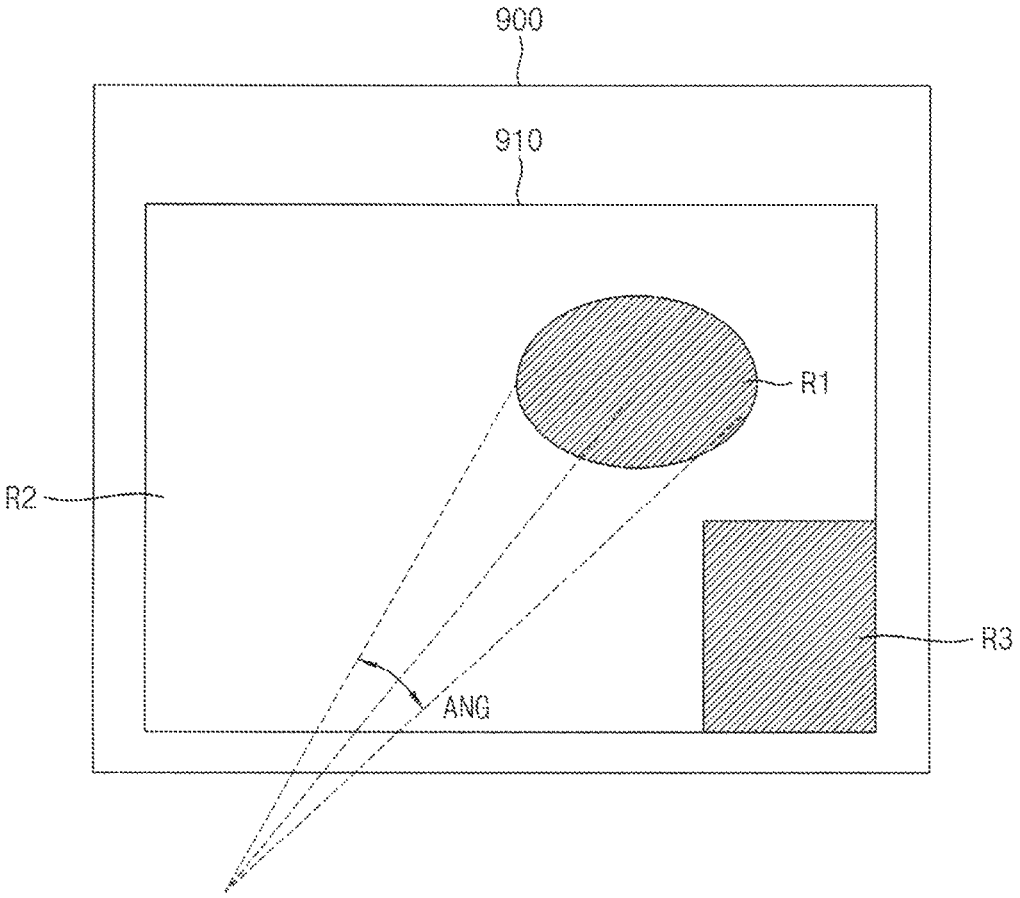
FIG. 9 is a diagram illustrating an example of the display device of FIG. 1.

FIG. 9 is a diagram illustrating an example of the display device of FIG. 1.

Referring to FIGS. 1 and 9, the display device 900 may be substantially the same as the display device 100 illustrated in FIG. 1. The display device 900 may further include a visual recognition sensor (not shown) to detect a view angle of a user. The display device 900 (or, the timing controller 120 included in the display device 900) may determine a first unapplied area R1 (or, non-applied region) of the display panel 910 corresponding to the viewing angle ANG of the user and may calculate the automatic-current-limit rate based on partial data corresponding to the first unapplied area R1 among input data. For example, the display device 900 may apply (or, employ) the automatic-current-limit technique to rest area (e.g., an applied area R2) except the unapplied area R1 of the display panel 910.

In some example embodiments, the display device 900 may calculate a location (or, a position, a point) corresponding to the user's eye (or, a visual axis) using the visual recognition sensor and may determine the first unapplied area R1 corresponding to a range of the viewing angle of the user (e.g., a range of the viewing angle in which the user recognize an object more accurately according to a distribution of visual cells of the user, for example, a range within 2 degrees or a range within 10 degrees). The display device 900 may determine an automatic-current-limit rate for the first unapplied area R1 to be 0% and may determine an automatic-current-limit rate for the second applied area R2 to be equal the automatic-current-limit rate described with reference to FIG. 2.

In an example embodiment, the display device 900 may gradually increase the automatic-current-limit rate according to a distance with respect to the user's eye (or, a visual axis).

In some example embodiments, the display device 900 may further include a hovering sensor (not shown) to detect an object between the user and the display panel 910, and the display device 900 (or, the timing controller 120) may determine a third applied area R3 based on the object. For example, the hovering sensor may be implemented as a proximity sensor, a gesture detection sensor, etc.

For example, the display device 900 may calculate a location (or, a position, a point) of the user's eye using the visual recognition sensor (not shown), may calculate a location of the object above the display panel 910 using the hovering sensor, and may determine the third applied area R3 (e.g., some area of the display panel which is covered by the object with respect the location of the user's eyes) based on the location of the user's eyes and the location of the object. In this case, the display device 900 may calculate the automatic-current-limit rate based on partial data corresponding to the third applied area R3 of the input data. For example, the display device 900 may apply the automatic-current-limit rate having a relatively high value (e.g., 25%, 100%) to the third applied area R3 of the display panel 910.

As described with reference to FIG. 9, the display device 900 according to example embodiments may determine the first unapplied area R1 corresponding to the view angle of the user using the visual recognition sensor and may apply the automatic-current-limit rate for the first unapplied area R1 to be 0% (or, may not employ the automatic-current-limit technique to the first unapplied area R1). Therefore, the display device 900 may prevent that luminance reduction is visible for the user. In addition, the display device 900 may detect the object between the user (or, the user's eyes) and the display panel 910, may determine the third applied area R3 (e.g., an area covered by the object and not visible for the user) corresponding to the object, and may apply the automatic-current-limit rate having a relatively high value to the third applied area R3. Therefore, the display device 900 may maximize an effect of reducing the power consumption.

Figure 10:
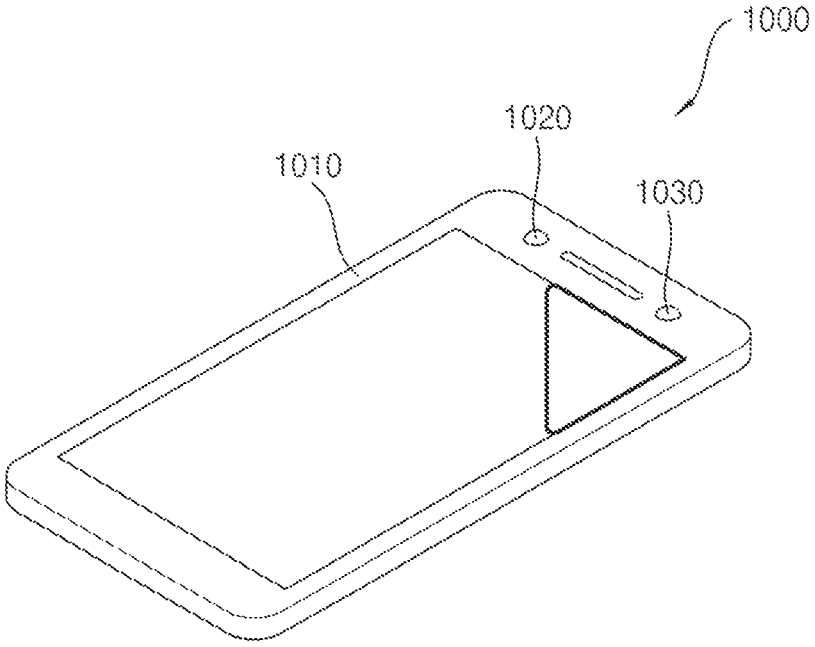
FIG. 10 is a diagram illustrating an example of the display device of FIG. 1.

FIG. 10 is a diagram illustrating an example of the display device of FIG. 1.

Referring to FIGS. 1 and 10, the display device 1000 may be substantially the same as the display device 100 described with reference to FIG. 1 and may further include a gravity sensor 1020 and a light sensor 1030.

The display device 1000 (or, the timing controller included in the display device 1000) may calculate a location (or, a position) of a light source using the gravity sensor 1020 and a light sensor 1030, may determine an applied area based on the location of the light source, and may calculate an automatic-current-limit rate based on partial data corresponding to the applied area among input data.

For example, the display device 1000 may sense a tilted degree of the display device 1000 using the gravity sensor, may sense the location of the light (or, a direction of light from the light source), and may calculate (or, determine) a reflection area of the display panel 1010 at which a light is reflected. In this case, the display device 1000 may calculate the automatic-current-limit rate (or, may use the automatic-current-limit technique) for the applied area (i.e., a remaining area except the reflection area).

As described above, the display device 1000 may determine the reflection area using the gravity sensor 1020 and the light sensor 1030 and may use the automatic-current-limit technique for the applied area (i.e., a remaining area except the reflection area). Therefore, the display device 1000 may prevent that a luminance reduction is visible for the user and may improve a display quality.

Figure 11:
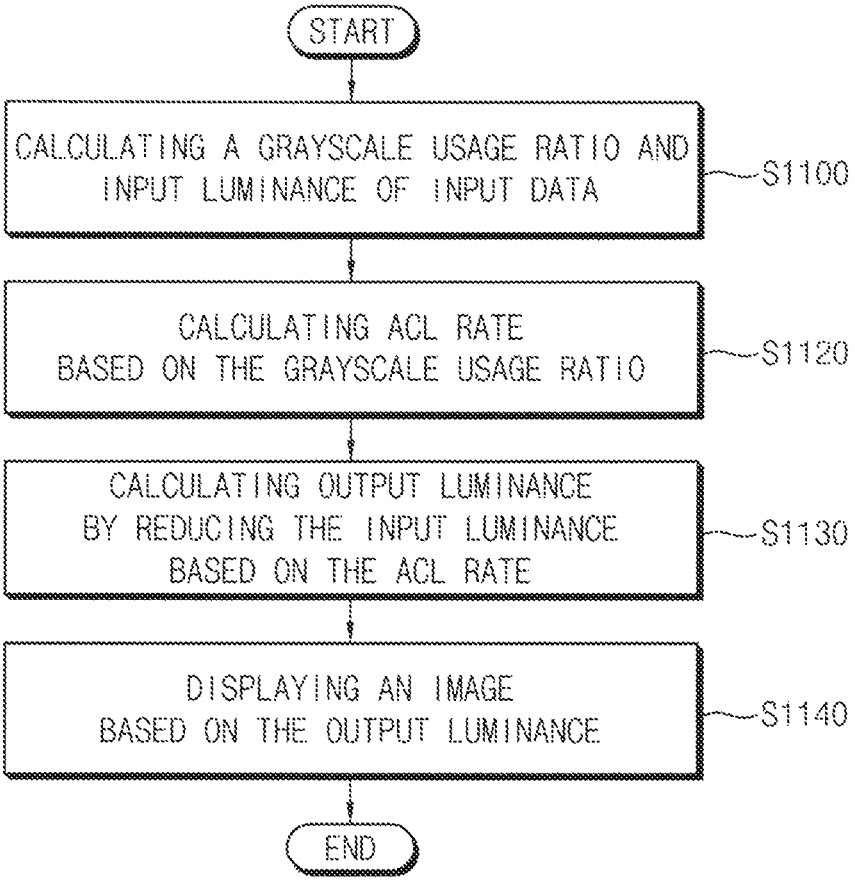
FIG. 11 is a flow chart illustrating a method of driving a display device according to example embodiments.

FIG. 11 is flow diagram illustrating a method of driving a display device according to example embodiments.

Referring to FIGS. 1 and 11, the method of FIG. 11 may drive the display device 100 of FIG. 1.

The method of FIG. 11 may calculate a grayscale usage ratio and an input luminance of input data (S1110). As described with reference to FIGS. 2 and 3A, the method of FIG. 11 may calculate the grayscale usage ratio GR based on a histogram (or, a grayscale distribution) of the input data. As described with reference to FIGS. 2 and 3B, the method of FIG. 11 may calculate the average on-pixel ratio OPR_AVE and the maximum on-pixel ratio OPR_MAX of the input data and may calculate the input luminance INPUT_Y based on the average on-pixel ratio OPR_AVE and the maximum on-pixel ratio OPR_MAX.

The method of FIG. 11 may calculate an automatic-current-limit rate based on the grayscale usage ratio (S1120). As described with reference to FIGS. 2 and 3C, the method of FIG. 11 may calculate the maximum automatic-current-limit rate ACL_OFF_MAX based on the first reference rate ACL_OFF1 when the grayscale usage ratio GR is greater than or equal to the reference grayscale usage ratio GR0 and may calculate the maximum automatic-current-limit rate ACL_OFF_MAX based on the first reference rate ACL_OFF1 and the second reference rate ACL_OFF2 when the grayscale usage ratio GR is less than the reference grayscale usage ratio GR0.

In some example embodiments, as described with reference to FIG. 3D, the method of FIG. 11 may calculate the first reduction rate RR1 and the second reduction rate RR2 based on the maximum automatic-current-limit rate ACL_OFF_MAX, where the first reduction rate RR1 is to reduce the on-duty (or, an on-duty rate) of the pixels 111, and the second reduction rate RR2 is to reduce (or, downscale) the input data. Here, a sum of the first and second reduction rates RR1 and RR2 may be equal to the maximum automatic-current-limit rate ACL_OFF_MAX.

The method of FIG. 11 may calculate an output luminance for the input data based on the input luminance and the maximum automatic-current-limit rate ACL_OFF_MAX (S1130). As described with reference to FIG. 3E, the method of FIG. 11 may calculate the output luminance OUTPUT_Y by reducing the input luminance INPUT_Y based on the maximum automatic-current-limit rate ACL_OFF_MAX when the input luminance INPUT_Y is greater than or equal to the reference luminance R_Y.

The method of FIG. 11 may display an image corresponding to the input data with the output luminance (S1140).

In some example embodiments, the method of FIG. 11 may display the image using (or, employing) the impulsive dimming driving (AID) method and the image converting method. As described with reference to FIG. 6, the method of FIG. 11 may generate the light emission control signal GC to reduce the on-duty of the pixels 111 based on the first reduction rate RR1. In addition, as described with reference to FIG. 3F, the method of FIG. 11 may reduce the input data using the second reduction rate RR2 (or, using the second mapping curve 362 or the third mapping curve 363 which are determined based on the second reduction rate RR2). The method of FIG. 11 may display the image by providing the light emission control signal GC and reduced data (or, a reduced data signal) to the pixels 111 as described with reference to FIG. 5.

The present inventive concept may be applied to any display device (e.g., an organic light emitting display device, a liquid crystal display device, etc). For example, the present inventive concept may be applied to a television, a computer monitor, a laptop, a digital camera, a cellular phone, a smart phone, a personal digital assistant (PDA), a portable multimedia player (PMP), an MP3 player, a navigation system, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A display device comprising:

a display panel including pixels;

a light emission element in each pixel;

a driving transistor transferring a driving current to the light emission element; and a timing controller configured to calculate a grayscale usage ratio of input data and to determine an automatic-current-limit rate based on the grayscale usage ratio, the automatic-current-limit rate representing a power saving rate, wherein the grayscale usage ratio is a ratio of a number of valid grayscale levels included in the input data to a total number of grayscale levels used in the display device, a usage ratio of the valid grayscale level being greater than a predetermined reference value, wherein the timing controller calculates the automatic-current-limit rate for regulating the driving current based on a first reference rate when the grayscale usage ratio is greater than a reference grayscale usage ratio and calculates the automatic-current-limit rate for regulating the driving current based on the first reference rate and a second reference rate when the grayscale usage ratio is less than a reference grayscale usage ratio; and wherein the second reference rate is greater than the first reference rate.

2. The display device of claim 1, wherein the timing controller is configured to determine a grayscale region corresponding to a previous grayscale usage ratio of previous input data among grayscale regions, to increase the automatic-current-limit rate when the grayscale usage ratio is less than a minimum value of the grayscale region, and to decrease the automatic-current-limit rate when the grayscale usage ratio is greater than a maximum value of the grayscale region by a predetermined threshold value, and wherein each of the grayscale regions is included in a range which is less than the reference grayscale usage ratio and each of the grayscale regions has a width which is equal to the predetermined threshold value.

3. The display device of claim 1, wherein the timing controller is configured to calculate an input luminance of the input data and to calculate an output luminance of the input data by reducing the input luminance based on the automatic-current-limit rate, and wherein the display panel displays an image corresponding to the input data based on the output luminance.

4. The display device of claim 3, wherein the timing controller is configured to calculate an average on-pixel ratio of the pixels and a maximum on-pixel ratio of the pixels based on the input data and to calculate the input luminance based on the average on-pixel ratio and the maximum on-pixel ratio.

5. The display device of claim 4, wherein the average on-pixel ratio is a ratio of a number of valid pixels which is activated based on the input data to a total number of the pixels, and wherein the maximum on-pixel ratio is a largest on-pixel ratio among sub average on-pixel ratios which are respectively calculated for each of the pixels having a same color.

6. The display device of claim 5, wherein the timing controller is configured to calculate the input luminance based on the average on-pixel ratio when the grayscale usage ratio is greater than the reference grayscale usage ratio and to calculate the input luminance based on the average on-pixel ratio and the maximum on-pixel ratio when the grayscale usage ratio is less than the reference grayscale usage ratio.

7. The display device of claim 1, wherein the timing controller calculates a first reduction rate to reduce on-duty of the pixels and a second reduction rate to downsize the input data based on the automatic-current-limit rate, wherein the second reduction rate is equal to an excess-rate by which the automatic-current-limit rate excesses a reference reduction rate, and wherein the automatic-current-limit rate is equal to a sum of the first reduction rate and the second reduction rate.

8. The display device of claim 7, further comprising:

an emission driver configured to generate a light emission control signal to control the on-duty based on the first reduction rate.

9. The display device of claim 7, wherein the timing controller generates converted data by downsizing the input data based on the second reduction rate.

10. The display device of claim 9, wherein the timing controller increases a chroma on a color difference coordinate of the converted data.

11. The display device of claim 1, further comprising:

driving modes including a normal driving mode and a power saving driving mode; and a graphic user interface configured to control the driving mode, wherein the timing controller calculates the automatic-current-limit rate in the power saving driving mode and do not calculate the automatic-current-limit rate in the normal driving mode.

12. The display device of claim 1, further comprising:

a visual recognition sensor configured to detect a viewing angle of a user, wherein the timing controller determines an unapplied area of the display panel corresponding to the view angle and calculates the automatic-current-limit rate based on the unapplied area.

13. The display device of claim 12, further comprising:

a hovering sensor configured to detect an object between the user and the display panel, wherein the timing controller determines the unapplied area based on the view angle and a location of the object.

14. The display device of claim 1, further comprising:

a gravity sensor and light sensor, wherein the timing controller is configured to calculate a location of a light source, to determine an applied area based on the location of the light source, and to calculate the automatic-current-limit rate based on partial data corresponding to the applied area.

15. A display device comprising:

a display panel including pixels; and a timing controller configured to calculate an average on-pixel ratio of the pixels and a maximum on-pixel ratio of the pixels based on input data, to calculate an input luminance of the input data based on the average on-pixel ratio and the maximum on-pixel ratio, and to calculate an output luminance by reducing the input luminance when the input luminance is greater than a reference luminance, wherein the display panel displays an image corresponding to the input data with the output luminance, wherein the average on-pixel ratio is a ratio of a number of valid pixels which is activated based on the input data to a total number of the pixels, wherein the maximum on-pixel ratio is a largest on-pixel ratio among sub average on-pixel ratios which are respectively calculated for each of the pixels having a same color, wherein a grayscale usage ratio of the input data is a ratio of a number of valid grayscale levels included in the input data to a total number of grayscale levels used in the display device, a usage ratio of the valid grayscale level being greater than a predetermined reference value, and wherein the timing controller is configured to calculate the grayscale usage ratio of the input data, to calculate the input luminance based on the average on-pixel ratio when the grayscale usage ratio is greater than a reference grayscale usage ratio, and to calculate the input luminance based on the average on-pixel ratio and the maximum on-pixel ratio when the grayscale usage ratio is less than the reference grayscale usage ratio.

* * * * *